US009289989B2

(12) United States Patent
Hagiwara

(10) Patent No.: US 9,289,989 B2
(45) Date of Patent: Mar. 22, 2016

(54) LIQUID EJECTING HEAD AND LIQUID EJECTING APPARATUS

(71) Applicant: Seiko Epson Corporation, Tokyo (JP)

(72) Inventor: Hiroyuki Hagiwara, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/579,055

(22) Filed: Dec. 22, 2014

(65) Prior Publication Data

US 2015/0183217 A1 Jul. 2, 2015

(30) Foreign Application Priority Data

Dec. 26, 2013 (JP) ..... 2013-270570

(51) Int. Cl.
*B41J 2/15* (2006.01)
*B41J 2/14* (2006.01)

(52) U.S. Cl.
CPC .... *B41J 2/14233* (2013.01); *B41J 2002/14241* (2013.01); *B41J 2002/14362* (2013.01); *B41J 2002/14419* (2013.01); *B41J 2002/14491* (2013.01)

(58) Field of Classification Search
CPC .... B41J 2/175; B41J 2/17513; B41J 2/17509; B41J 2/18; B41J 2/17523
See application file for complete search history.

(56) References Cited

U.S. PATENT DOCUMENTS 8,590,756 B2 * 11/2013 Baker ..... B41J 2/17513 222/464.6
8,876,269 B2 * 11/2014 Hirano ..... B41J 2/175 347/22
8,936,356 B2 * 1/2015 Yoshida ..... B41J 29/377 347/6
2013/0201248 A1 8/2013 Owaki et al.

FOREIGN PATENT DOCUMENTS

JP 2003-011356 A 1/2003
JP 2010-194901 A 9/2010
JP 2013-176962 A 9/2013
JP 2013-176963 A 9/2013

* cited by examiner

*Primary Examiner* — Lamson Nguyen
(74) *Attorney, Agent, or Firm* — Harness, Dickey & Pierce, P.L.C.

(57) ABSTRACT

Provided is a liquid ejecting head including a liquid ejection surface through which liquid is ejected, a head casing body in which the liquid ejection surface is provided on one surface, an atmosphere opening port which is open in an outer-side wall surface of the head casing body, a first space portion which communicates with the atmosphere opening port in the head casing body, and a second space portion which communicates with the first space portion through a connection path. The first space portion reserves liquid entering through the atmosphere opening port.

20 Claims, 21 Drawing Sheets

LIQUID EJECTING HEAD AND LIQUID EJECTING APPARATUS

CROSS REFERENCES TO RELATED APPLICATIONS

This application claims priority to Japanese Patent Application No. 2013-270570 filed on Dec. 26, 2013. The entire disclosure of Japanese Patent Application No. 2013-270570 is hereby incorporated herein by reference.

BACKGROUND

1. Technical Field

The present invention relates to a liquid ejecting head which ejects liquid through nozzle openings and a liquid ejecting apparatus and, particularly, relates to an ink jet type recording head which ejects ink as liquid and an ink jet type recording apparatus.

2. Related Art

A liquid ejecting apparatus represented by an ink jet type recording apparatus, such as an ink jet type printer and a plotter, has a liquid ejecting head which can eject droplets of liquid from a liquid reservoiring unit, such as a cartridge and a tank having liquid reserved therein.

Such a liquid ejecting head includes a pressure generation chamber communicating with nozzle openings through which liquid is ejected and a pressure generation unit which generates changes in pressure in the liquid in the pressure generation chamber and causes liquid droplets to be ejected through the nozzle openings. Examples of a pressure generation unit mounted on a liquid ejecting head include a longitudinal oscillation type piezoelectric actuator, a deflection oscillation type piezoelectric actuator, and an actuator using a heater element or an electrostatic force.

In this case, the liquid ejecting head includes a head main body which ejects liquid and a flow-path member which is provided on a surface side of the head main body, which is the side opposite to a liquid ejection surface side. The liquid is supplied from the flow-path member to the head main body (see, for example, JP-A-2013-176963 or JP-A-2013-176962).

In the case of an ink jet type recording head, when a sealed space is provided in a case body, a problem, such as deformation and a failure in bonding of member, is caused by the expansion/contraction of gas, resulting from changes in temperature. Thus, an atmosphere opening port communicating with the outside is provided in the casing body and the inner portion of the casing body is open to the atmosphere through the atmosphere opening port. In addition, when a solvent-based ink is used, the concentration of volatile components increases in the head, and thus a problem, such as separation in a bonded portion and changes in discharging properties of the head, resulting from changes in elasticity of a film compliance portion, can occur. To prevent this problem, the space in the head is open to the atmosphere.

However, there is a problem in that, when the ink is adhered to the atmosphere opening port, the ink enters an inner portion of the ink jet type recording head through the atmosphere opening port, and thus components in the inner portion of the ink jet type recording head may not function due to the ink.

Such a problem is not limited to an ink jet type recording head and is shared by liquid ejecting heads for ejecting liquid other than ink.

SUMMARY

An advantage of some aspects of the invention is to provide a liquid ejecting head capable of preventing entrance of liquid and a liquid ejecting apparatus.

According to an aspect of the invention, there is provided a liquid ejecting head including, a liquid ejection surface through which liquid is ejected, a head casing body in which the liquid ejection surface is provided on one surface, an atmosphere opening port which is open in an outer-side wall surface of the head casing body, a first space portion which communicates with the atmosphere opening port in the head casing body, and a second space portion which communicates with the first space portion through a connection path, in which the first space portion reserves liquid entering through the atmosphere opening port.

In this case, since the liquid entering through the atmosphere opening port is reserved in the first space portion, the liquid can be prevented from entering the second space portion.

In the liquid ejecting head, it is preferable that the connection path be disposed further to an upper side in a vertical direction than the atmosphere opening port. In this case, even when the liquid is reserved in the first space portion, the liquid is discharged through the atmosphere opening port before the liquid enters the second space portion through the connection path. In other words, when the level of the liquid reserved in the first space portion reaches the atmosphere opening port, the liquid exceeding this level is prevented from entering the first space portion. As a result, the liquid can be prevented from entering the second space portion through the connection path.

In addition, the liquid ejecting head may include a circuit substrate which is held in the second space portion.

Furthermore, the circuit substrate may be connected to an external wiring substrate inserted through a connection hole which is provided in the head casing body and communicates with the second space portion. The connection hole may be sealed by a sealing member.

According to another aspect of the invention, there is provided a liquid ejecting head including a liquid ejection surface through which liquid is ejected, a head casing body in which the liquid ejection surface is provided on one surface, an atmosphere opening port which is open in an outer-side wall surface of the head casing body, and a corner portion which is provided in the wall surface having an atmosphere opening port formed therein and which is formed by the wall surface and a surface intersecting with the wall surface, in which the corner portion is provided on at least an upper side of the atmosphere opening port in the vertical direction, and, in a direction perpendicular to the vertical direction in the wall surface, the width of the corner portion is greater than that of the atmosphere opening path.

In this case, even when the liquid applied to a part of the wall surface, which is located further to the upper side in the vertical direction than the atmosphere opening port, flows to the atmosphere opening port, the liquid flows along the corner portion. As a result, the liquid can be prevented from entering through the atmosphere opening port.

In the liquid ejecting head, it is preferable that the head casing body include a first space portion communicating with the atmosphere opening port and a second space portion connected to the first space portion through a connection path. In addition, it is preferable that the first space portion be able to receive liquid entering through the atmosphere opening port. In this case, even when, for example, the liquid getting over the corner portion or the liquid directly dropping into the atmosphere opening port enters through the atmosphere opening port, the liquid is reserved in the first space portion. As a result, the liquid can be prevented from entering the second space portion.

In the liquid ejecting head, it is preferable that the connection path be disposed further to an upper side in the vertical direction than the atmosphere opening port. In this case, even when the liquid is reserved in the first space portion, the liquid is discharged through the atmosphere opening port before the liquid enters the second space portion through the connection path. In other words, when the level of the liquid reserved in the first space portion reaches the atmosphere opening port, the liquid exceeding this level is prevented from entering the first space portion. As a result, the liquid can be prevented from entering the second space portion through the connection path.

In the liquid ejecting head, it is preferable that the corner portion be formed to surround the atmosphere opening port. In this case, the corner portion is always formed further to the upper side in the vertical direction than the atmosphere opening port. Accordingly, even when the liquid ejecting direction of the liquid ejecting head is set to any angular direction, the liquid can be prevented from entering through the atmosphere opening.

In the liquid ejecting head, it is preferable that the corner portion be formed by a concave-shaped groove portion in the wall surface. In this case, it is not necessary to provide, for example, a convex portion. As a result, the liquid ejecting head can be reduced in size.

In the liquid ejecting head, it is preferable that a wall portion extending from a vertically lower side than the atmosphere opening port to a vertically upper side be provided on an inner-side surface of the first space portion, in which the atmosphere opening port is provided. In this case, since the wall portion is provided, it is possible to further prevent the liquid from entering through the atmosphere opening port.

According to still another aspect of the invention, there is provided a liquid ejecting apparatus including the liquid ejecting head of the aspects.

In this case, the damage due to entrance of liquid is prevented, and thus the liquid ejecting apparatus having improved reliability can be achieved.

Even when the liquid ejecting apparatus includes a plurality of the liquid ejecting heads and a liquid ejection surface of a first liquid ejecting head and a liquid ejection surface of a second liquid ejecting head are disposed in different directions, the liquid can be prevented from entering the inner portion of the liquid ejecting head.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, details of embodiments of the invention will be described.

Embodiment 1

Figure 1:
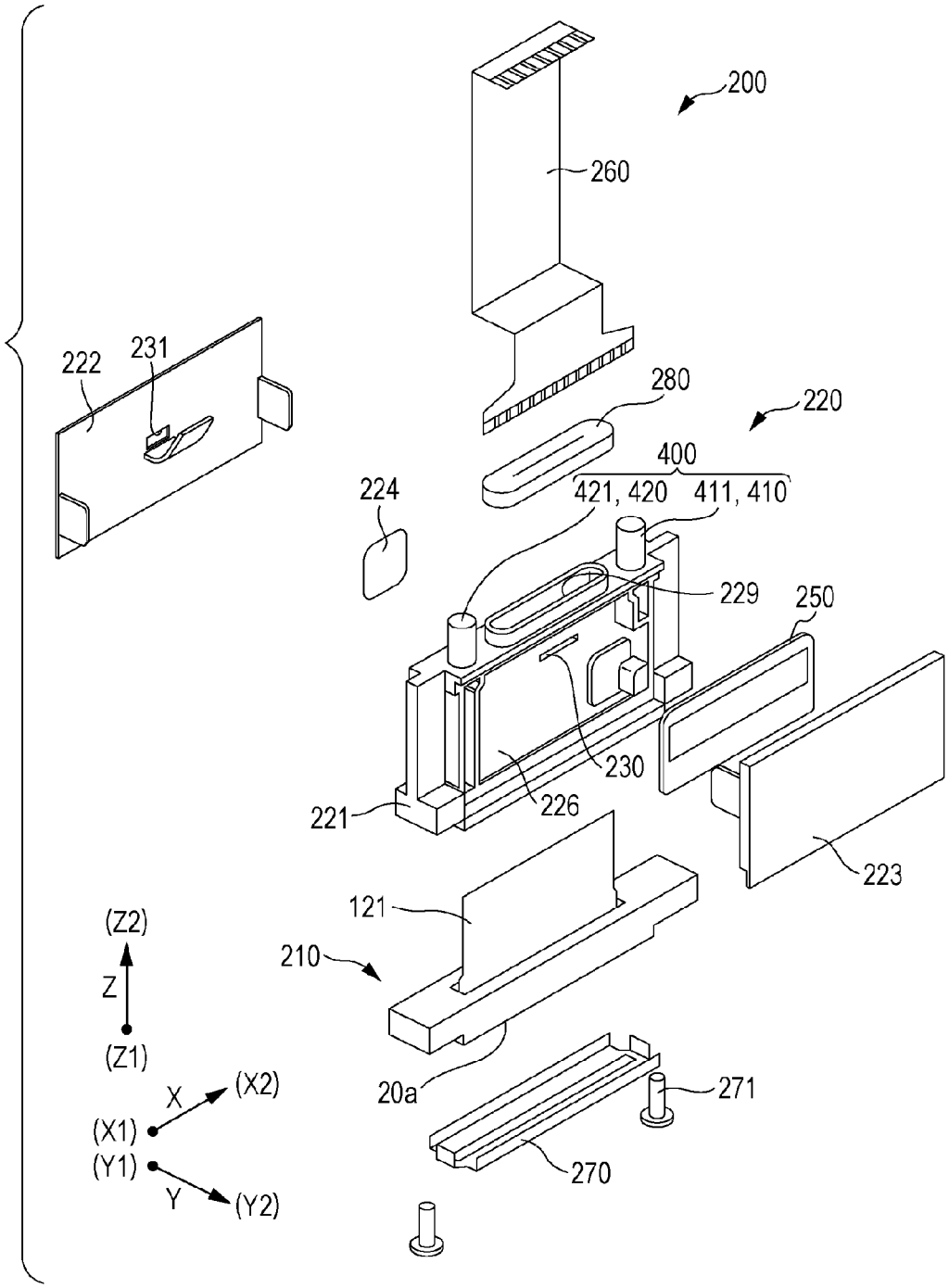
FIG. 1 is an exploded perspective view of a recording head according to Embodiment 1.
Figure 2:
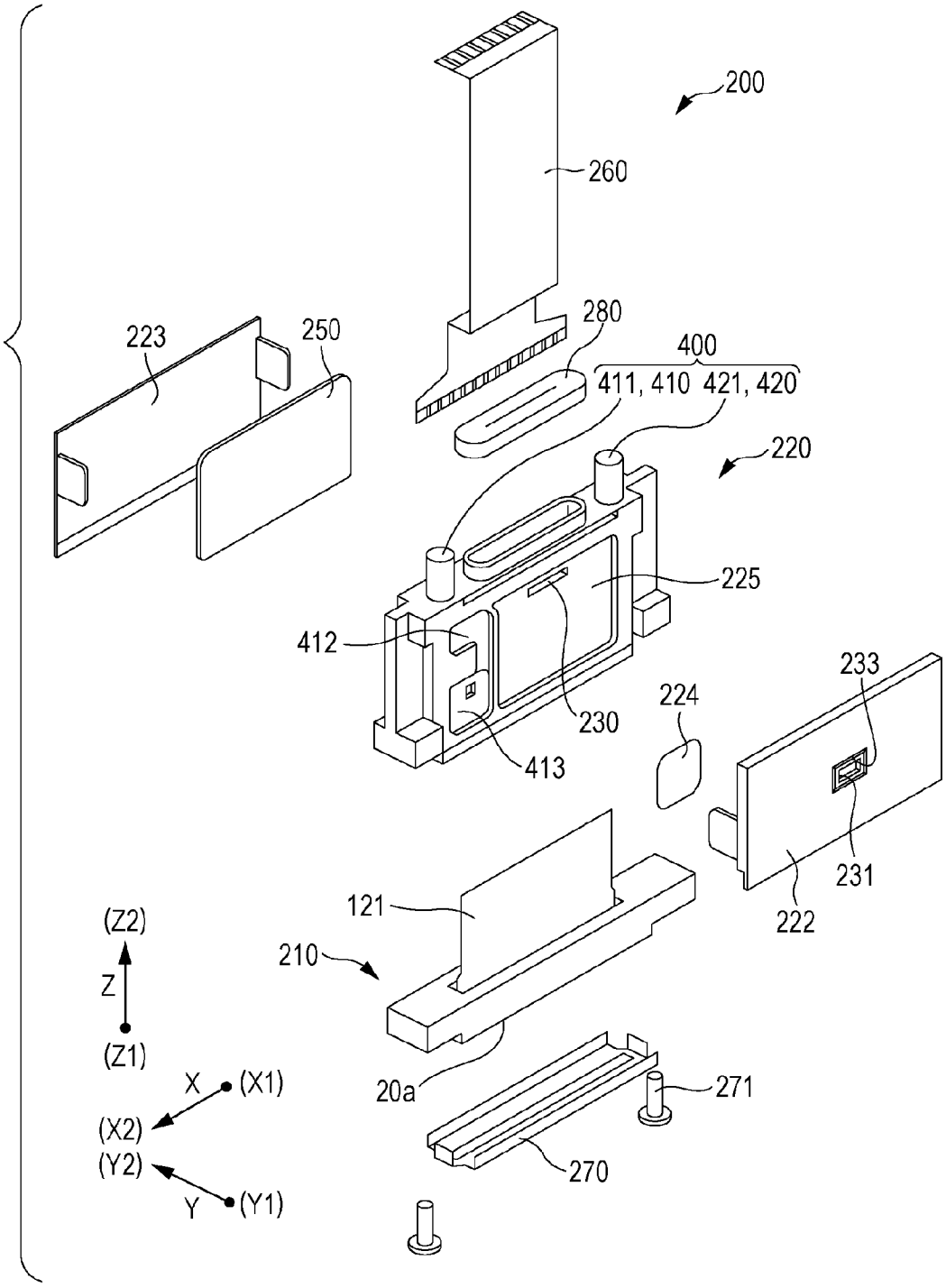
FIG. 2 is an exploded perspective view of the recording head according to Embodiment 1.

FIGS. 1 and 2 are exploded perspective views of an ink jet type recording head as an example of a liquid ejecting head according to Embodiment 1 of the invention.

An ink jet type recording head 200 as an example of a liquid ejecting head of this embodiment includes a head main body 210 which ejects, as liquid, ink droplets, a flow-path member 220 which supplies ink to the head main body 210, a circuit substrate 250 which is held in the flow-path member 220, an external wiring substrate 260 which is connected to the circuit substrate 250, and a cover head 270, as illustrated in the accompanying drawings.

Figure 3:
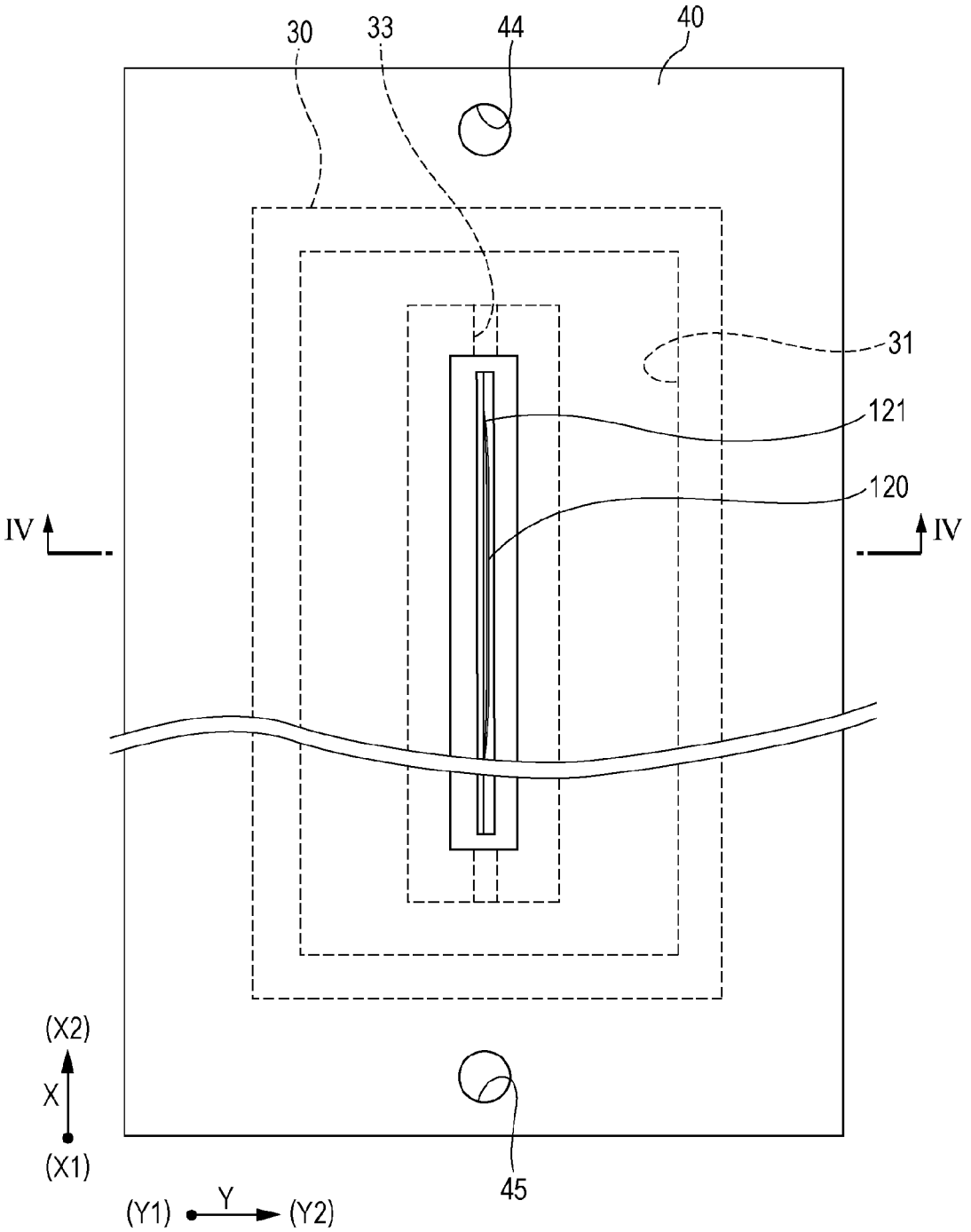
FIG. 3 is a plan view of a head main body according to Embodiment 1.
Figure 4:
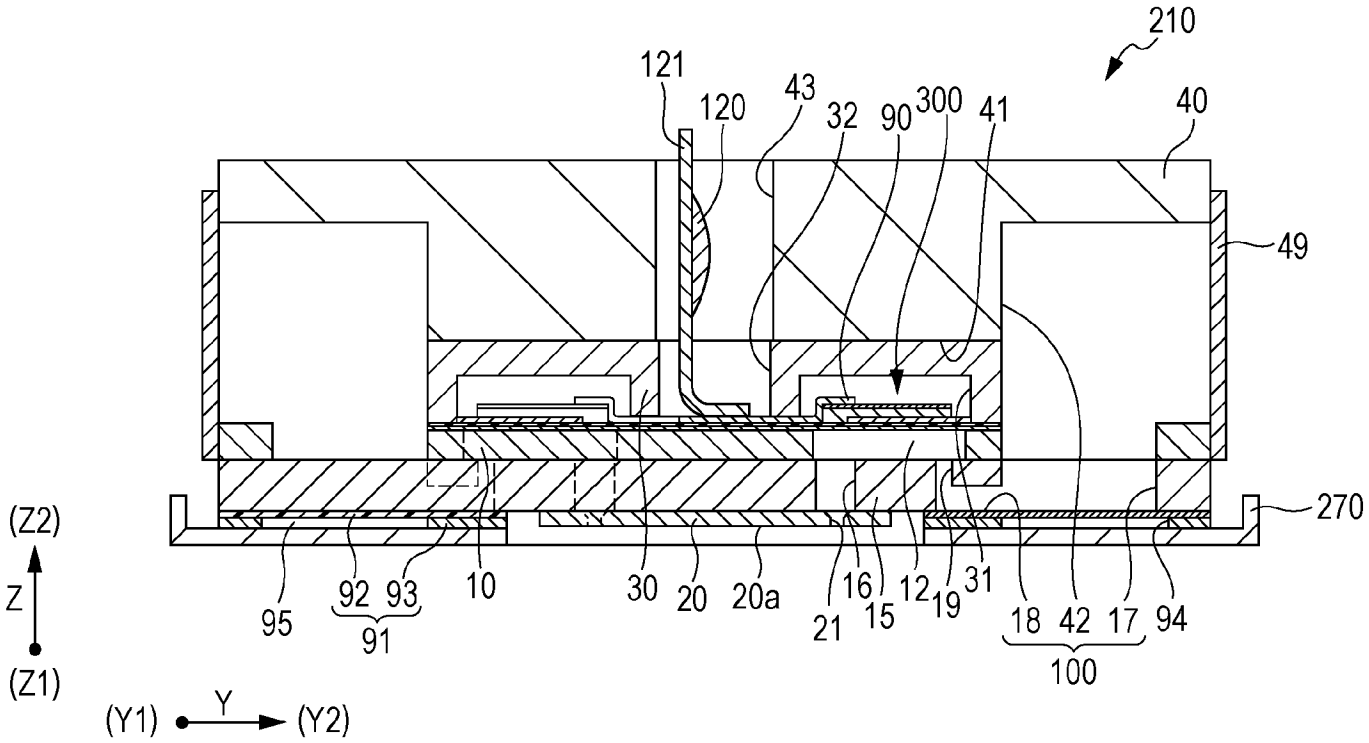
FIG. 4 is a cross-sectional view of the head main body according to Embodiment 1.

Here, the head main body 210 will be described with reference to FIGS. 3 and 4. FIG. 3 is a plan view of a head main body and FIG. 4 is a cross-sectional view taken along line IV-IV in FIG. 3.

The head main body 210 includes a plurality of members, such as a flow-path forming substrate 10, a communication plate 15, a nozzle plate 20, a protection substrate 30, a case member 40, or a compliance substrate 91. The head main body 210 is constituted by bonding the plurality of members using, for example, an adhesive, as illustrated in the drawings.

In the flow-path forming substrate 10 constituting the head main body 210, a plurality of pressure generation chambers 12 are aligned in the direction in which a plurality of nozzle openings 21 are aligned. Hereinafter, this direction will be referred to as an alignment direction of the pressure generation chambers 12 or a first direction X. Furthermore, in the flow-path forming substrate 10, a plurality of rows, each of which is constituted by the pressure generation chambers 12 aligned in the first direction X are provided. The number of rows is two in this embodiment. Hereinafter, a row-alignment direction in which a plurality of the rows of the pressure generation chambers 12, each of which is constituted by the pressure generation chambers 12 aligned in the first direction X, are aligned will be referred to as a second direction Y. The two rows, each of which is constituted by the pressure generation chambers 12 aligned in the first direction X, are arranged in a state where the other row of the pressure generation chamber 12 is disposed, relative to one row of the pressure generation chamber 12, at position staggered by half of the gap between the adjacent pressure generation chambers 12 in the first direction X. Accordingly, the nozzle openings 21 described below in detail are also arranged in a state where two rows of the nozzle opening 21 are staggered, in the first direction X, by half of the gap therebetween. As a result, the resolution in the first direction X is doubled. Needless to say, the two rows of the pressure generation chamber 12 may be disposed at the same position, in relation to the first direction X, and a different ink may be supplied for each row of the pressure generation chamber 12. In this embodiment, a direction perpendicular to both the first direction X and the second direction Y is referred to as a third direction Z. Furthermore, in a plane including the third direction Z, a side (a side of a recording sheet S described below which is an ejection receiving medium) in a liquid ejecting direction is referred to as a Z1 side and the opposite side is referred to as a Z2 side.

The communication plate 15 is bonded to one surface, that is, a Z1-side surface, of the flow-path forming substrate 10 in the third direction Z. The nozzle plate 20 having the nozzle openings 21 is bonded further to the Z1 side of the communication plate 15 in the third direction Z. In this embodiment, The Z1 side of the nozzle plate 20 in the third direction Z, in which the nozzle openings 21 are opened, is a liquid ejection surface 20*a*.

A nozzle communication path 16 through which the pressure generation chamber 12 communicates with the nozzle opening 21 is provided in the communication plate 15. The area of the communication plate 15 is greater than that of the flow-path forming substrate 10 and the area of the nozzle plate 20 is smaller than that of the flow-path forming substrate 10. A reduction in costs can be achieved by using the nozzle plate 20 having the relatively small area, as described above. The area referred to in this case means the area in an in-plane direction including both the first direction X and the second direction Y.

A first manifold portion 17 and a second manifold portion 18 which constitute a part of a manifold 100 are provided in the communication plate 15.

The first manifold portion 17 is formed in a state where the first manifold portion 17 passes through the communication plate 15 in the third direction Z.

The second manifold portion 18 does not pass through the communication plate 15 in the third direction Z. The second manifold portion 18 is opened to the nozzle plate 20 side, that is, the Z1 side, of the communication plate 15 and extends to the middle portion in the third direction Z.

In addition, a supply communication path 19 which communicates with one end portion of the pressure generation chamber 12 in the second direction Y is separately provided in the communication plate 15 for each pressure generation chamber 12. The supply communication path 19 passes through the communication plate 15 in the third direction Z and causes the second manifold portion 18 to communicate with the pressure generation chamber 12.

Meanwhile, a diaphragm is formed on a surface side, that is, the Z2 side, of the flow-path forming substrate 10, which is the surface side opposite to the communication plate 15 side. In addition, a piezoelectric actuator 300 as a pressure generation unit of this embodiment is constituted in such a manner that a first electrode, a piezoelectric layer, and a second electrode overlap on the diaphragm, in this order. Generally, one electrode of the piezoelectric actuator 300 is set to a common electrode. The other electrode and the piezoelectric layer are formed by performing patterning for each pressure generation chamber 12.

Furthermore, the protection substrate 30 having substantially the same size as that of the flow-path forming substrate 10 is bonded to a surface of the flow-path forming substrate 10, which is the surface on the piezoelectric actuator 300 side, that is, the Z2 side. The protection substrate 30 has a holding portion 31 which is a space for protecting the piezoelectric actuator 300. Two holding portions 31 are aligned in the second direction Y and correspond to rows, each of which is constituted by the piezoelectric actuators 300 aligned in the first direction X. The two holding portions 31, each of which is provided for each row of the piezoelectric actuator 300, communicate with each other in both end portions of the protection substrate 30 in the first direction X. In addition, in the protection substrate 30, a through-hole 32 is provided in a portion between the two holding portions 31 aligned in the second direction Y, in a state where the through-hole 32 passes through the protection substrate 30 in the third direction Z. An end portion of a lead electrode 90 drawn from the electrode of the piezoelectric actuator 300 extends so as to be exposed to the inner side of the through-hole 32. The lead electrode 90 and a wiring substrate 121 having a driving circuit 120, such as a driving IC, installed therein are electrically connected in the through-hole 32.

An atmosphere opening path 33 is provided in the protection substrate 30 to cause the holding portion 31 to communicate with the outside. Since the two holding portions 31 of this embodiment communicate in both end portions in the first direction X, one atmosphere opening path 33 is provided for two holding portions 31. The two holding portions 31 may be separately provided in a state where the holding portions 31 do not communicate with each other and the atmosphere opening path 33 may be provided for each separate holding portion 31.

As will be described below in detail, such an atmosphere opening path 33 communicates with the inner side of the flow-path member 220 via both the through-hole 32 and a connection port 43 of the case member 40 and, further, the atmosphere opening path 33 communicates with the outside via the inner side of the flow-path member 220.

The case member 40 is fixed to both the protection substrate 30 and the communication plate 15. The case member 40, along with the flow-path forming substrate 10 and the protection substrate 30, forms the manifold 100 communicating with a plurality of pressure generation chambers 12. In a plan view from the third direction Z, the case member 40 has substantially the same shape as the communication plate 15 described above. The case member 40 is bonded to the protection substrate 30 and, also, is bonded to the communication plate 15 described above. Specifically, in the case member 40, a concave portion 41 is formed on the protection substrate 30 side. The depth of the concave portion 41 is adequate for accommodating both the flow-path forming substrate 10 and the protection substrate 30. This concave portion 41 has an opening area greater than the surface area of the protection substrate 30, which is the surface bonded to the flow-path forming substrate 10. The opened surface of the concave portion 41 on the nozzle plate 20 side is sealed by the communication plate 15, in a state where the flow-path forming substrate 10 and the like are accommodated in the concave portion 41. Furthermore, the concave portion 41 of the case member 40 is opened to the lateral surface sides in the second direction Y. The opening of the concave portion 41 in the second direction Y is sealed by a covering member 49 as a second member. Accordingly, in an outer circumferential portion of the flow-path forming substrate 10, a third manifold portion is formed by the case member 40, the flow-path forming substrate 10, the protection substrate 30, and the covering member 49. Since the concave portion 41 constituting the third manifold portion 42 is opened to the lateral surface sides in the second direction Y and the openings are sealed by the covering members 49, the third manifold portion 42 can be formed having a large volume. Incidentally, when, for example, the concave portion is not opened in the second direction Y and is opened in only the third direction Z, a certain degree of hardness is necessary for the concave portion to function as walls in the second direction Y. As a result, the volume of the concave portion is reduced.

The manifold 100 of this embodiment is constituted by the first manifold portion 17 and second manifold portion 18, both of which are provided in the communication plate 15, and the third manifold portion 42 which is formed by the case member 40, the flow-path forming substrate 10, the protection substrate 30, and the covering member 49. In this embodiment, the manifolds 100 are formed on both sides between which the flow-path forming substrate 10 is interposed from the second direction Y. Needless to say, the configuration of the manifold 100 is not particularly limited thereto. The manifold 100 may be constituted by, for example, only the third manifold portion 42 and the manifold 100 may be constituted by both the second manifold portion 18 and the third manifold portion 42. However, when the manifold 100 is constituted by the first manifold portion 17, the second manifold portion 18, and the third manifold portion 42, as in the case of this embodiment, the manifold 100 can be formed to have a volume as large as possible, without increasing the size of the ink jet type recording head 200.

The connection port 43 which communicates with the through-hole 32 of the protection substrate 30 and passes through the case member 40 in the third direction Z is provided in the case member 40. The wiring substrate 121 inserted through the connection port 43 is inserted through the through-hole 32 and connected to the lead electrode 90.

An inflow path 44 and an outflow path 45 are provided in the case member 40. The inflow path 44 communicates with the manifold 100 and supplies ink to the manifold 100. The outflow path 45 communicates with the manifold 100 and causes the ink in the manifold 100 to flow out therethrough. Such an inflow path 44 is provided on one side of the flow-path forming substrate 10 in the first direction X and the outflow path 45 is provided on the other side of the flow-path forming substrate 10 in the first direction X. The inflow path 44 communicates with two manifolds 100 and the outflow path 45 communicates with two manifolds 100. The inflow path 44 to which the same ink is supplied branches into two paths in the middle and the same ink is supplied to the two manifolds 100 through the two paths. The branched paths of the outflow path 45, which respectively communicate with the manifolds 100, are joined in the middle, and thus the ink in the manifolds 100 flows out through one outlet. Needless to say, the inflow path 44 may be separately provided for each manifold 100, in a state where the inflow path 44 does not branch in the middle. Furthermore, the outflow path 45 may be separately provided for each manifold 100, in a state where the branched paths of the outflow path 45 are not joined in the middle.

The compliance substrate 91 is provided in the surface of the communication plate 15, in which both the first manifold portion 17 and the second manifold portion 18 are opened. This compliance substrate 91 seals the openings of both the first manifold portion 17 and the second manifold portion 18.

In this embodiment, such a compliance substrate 91 includes a sealing film 92 and a fixing substrate 93. The sealing film 92 is formed of a thin film (for example, polyphenylene sulfide (PPS) or stainless steel (SUS)) having flexibility. In addition, the fixing substrate 93 is formed of a hard material, for example, metal such as stainless steel (SUS). A part of the fixing substrate 93, which faces the manifold 100, is completely removed in a thickness direction and forms an opening portion 94. Thus, one surface of the manifold 100 is sealed by only the sealing film 92 having flexibility and forms a compliance portion which is flexible.

A cover head 270 is fixed to the liquid ejection surface 20*a* side of the head main body 210, in which the nozzle openings 21 are opened. The cover head 270 protects the nozzle openings 21, in a state where the nozzle openings are exposed. The cover head 270 is bonded to the compliance substrate 91, and thus a space 95 is formed in a portion between the cover head 270 and the opening portion 94. When the space 95 is sealed, the gas in the space 95 cannot move, and thus the sealing film 92 as the compliance portion cannot be flexibly deformed. Accordingly, it is necessary to cause the space 95 to be open to the atmosphere, in such a manner that the space 95 communicates with the outside. However, it is not preferable that an atmosphere opening port be provided in the cover head 270 and the space be open to the atmosphere, to the ejection receiving medium side. The reason for this is as follows. The ink enters from the ejection receiving medium side through the atmosphere opening port and the ink is applied to, for example, the sealing film 92. Thus, the sealing film 92 cannot be flexibly deformed. As a result, there is a concern that the compliance portion may not function. Accordingly, in this embodiment, although not illustrated, atmosphere opening paths communicating with the space 95 are provided in the compliance substrate 91, the communication plate 15, the flow-path forming substrate 10, and the like. Therefore, the space 95 communicates, through the atmosphere opening path, with the inner side of the through-hole 32 of the protection substrate 30, which is the side, that is, the Z2 side, opposite to the liquid ejection surface 20*a*. Although described below in detail, the space 95 communicates with the inner portion of the flow-path member 220, through the atmosphere opening path, the through-hole 32, and the connection port 43 of the case member 40. Then, the space 95 communicates with the outside through the inner portion of the flow-path member 220. Hereinafter, the atmosphere opening path 33 communicating with the holding portion 31 provided in the head main body 210, the atmosphere opening path (not illustrated) communicating with the space 95, and the like will be collectively referred to as an atmosphere opening path.

Such a head main body 210 is fixed, using two screw members 271 screwed into the flow-path member 220, to a surface of the flow-path member 220, which is the surface on the Z1 side, that is, the liquid ejection surface 20*a* side in the third direction Z, as illustrated in FIGS. 1 and 2.

Figure 5A:
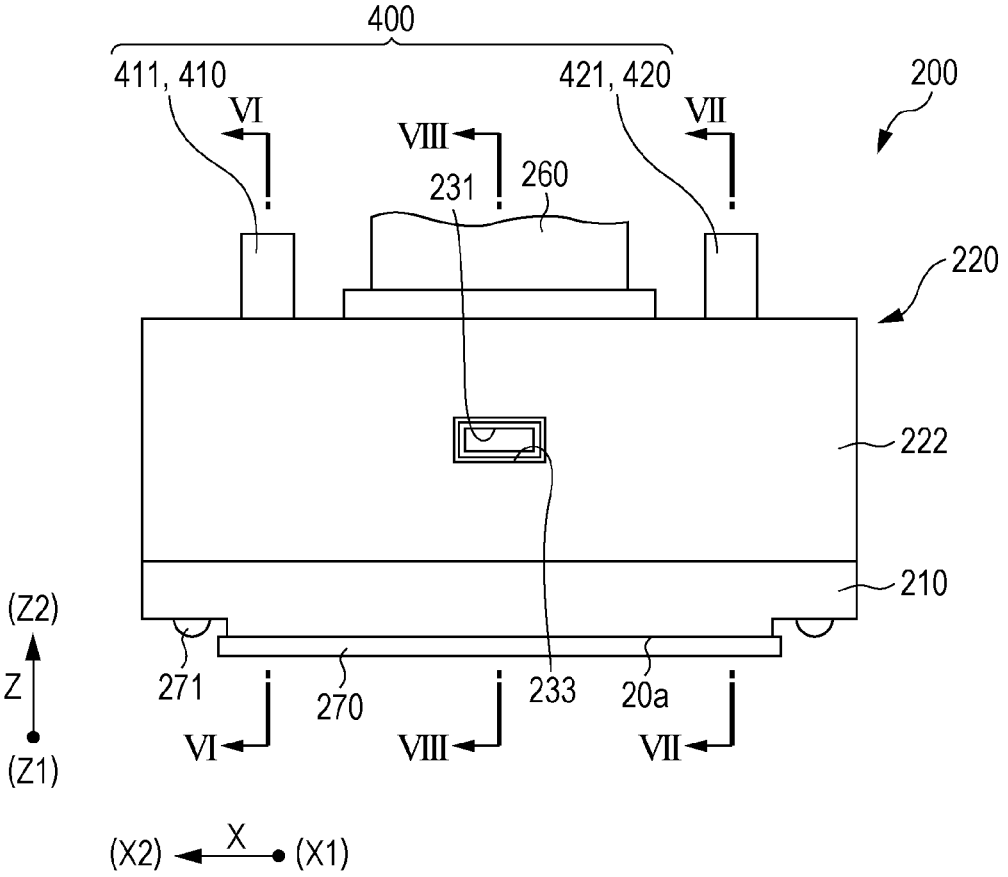
FIG. 5A is a plan view of the recording head according to Embodiment 1 and FIG. 5B is an enlarged view of a principal portion of the recording head.
Figure 5B:
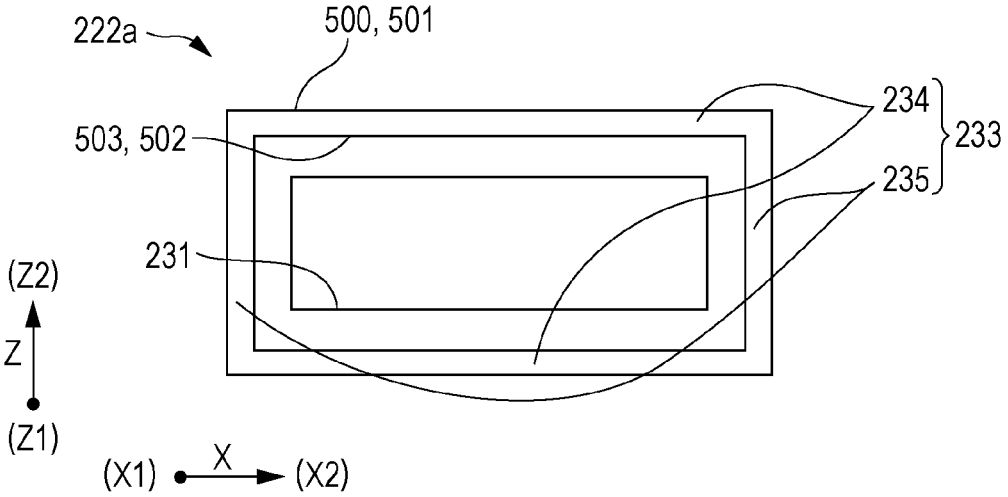
Figure 6:
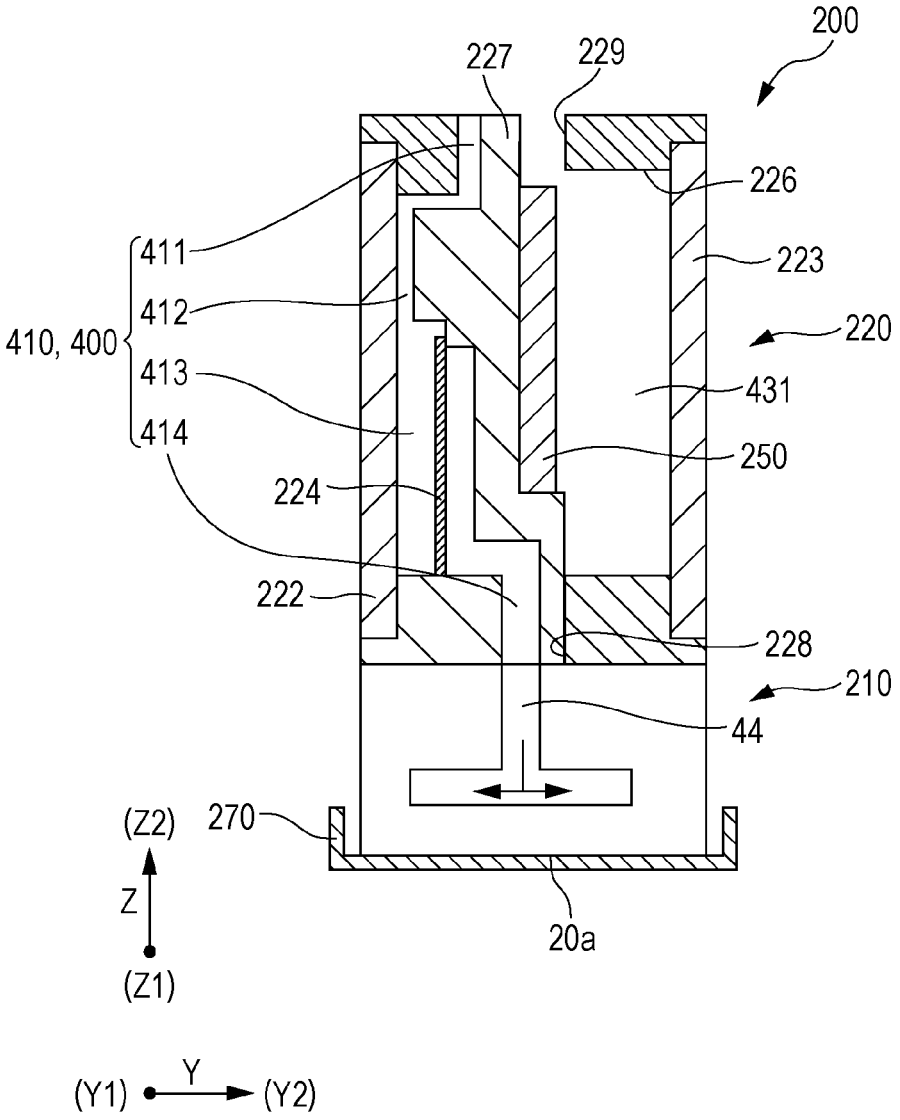
FIG. 6 is a cross-sectional view of a principal portion of the recording head according to Embodiment 1.
Figure 7:
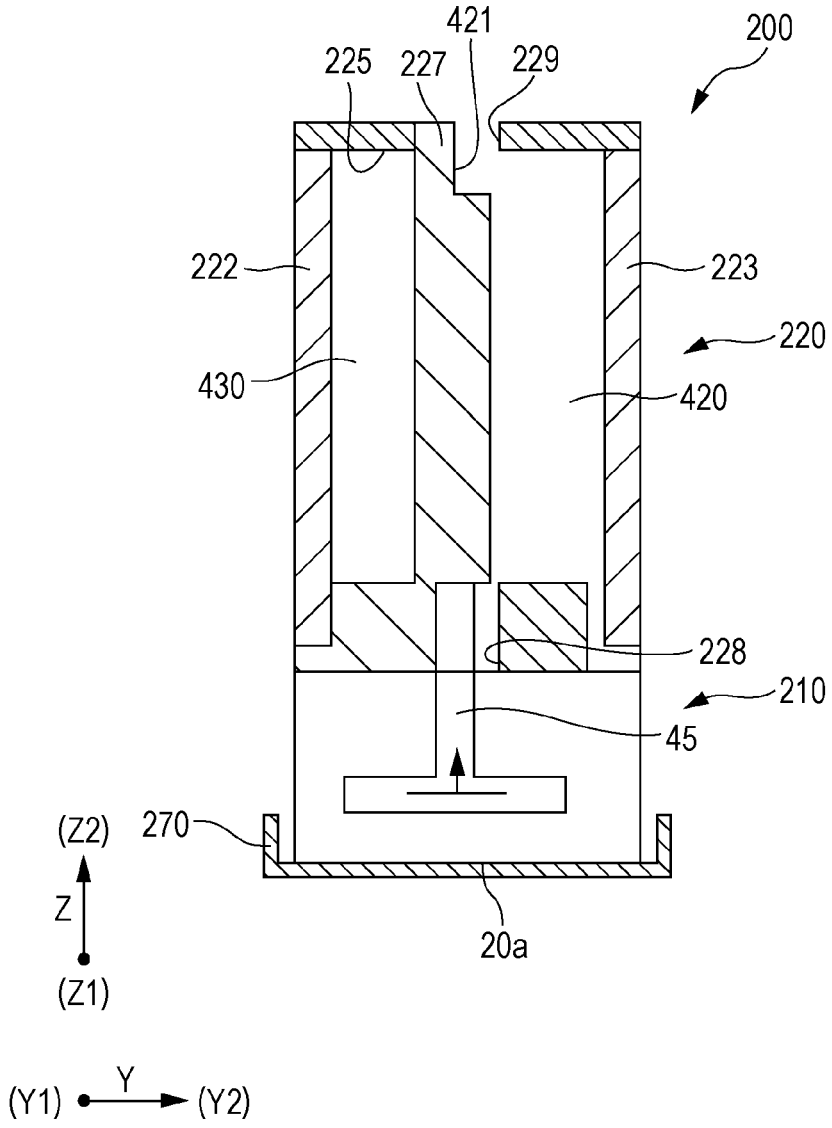
FIG. 7 is a cross-sectional view of a principal portion of the recording head according to Embodiment 1.
Figure 8:
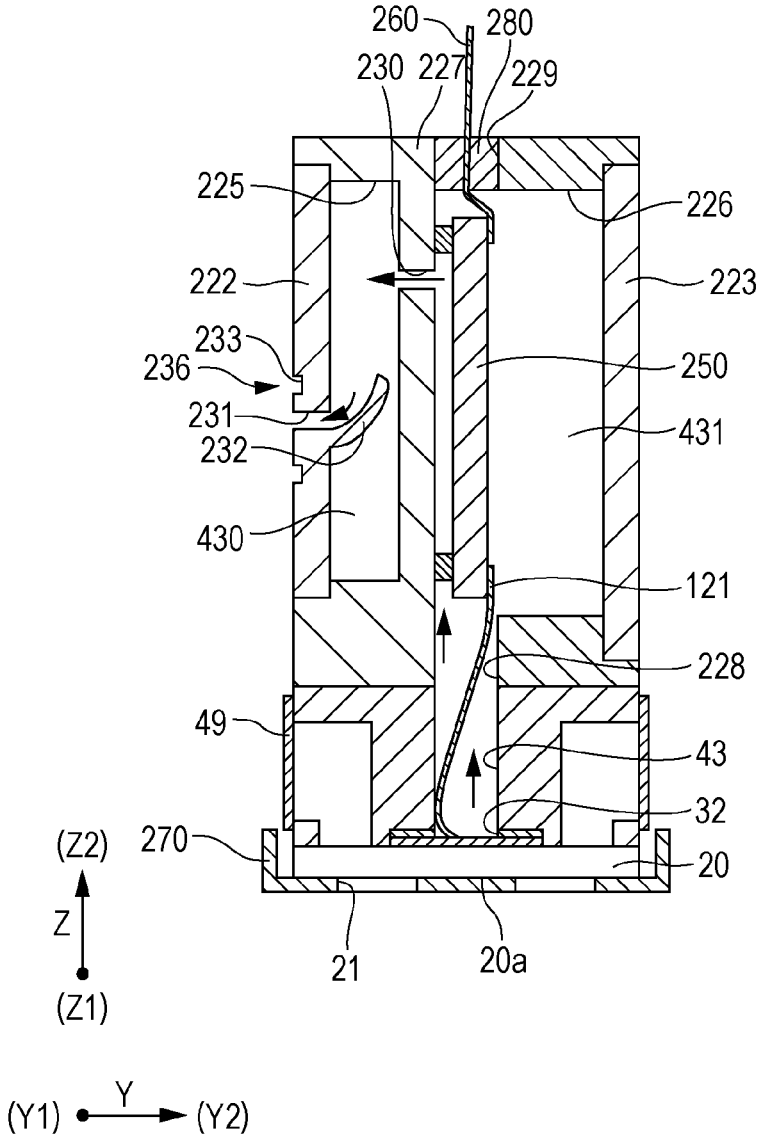
FIG. 8 is a cross-sectional view of a principal portion of the recording head according to Embodiment 1.
Figure 9:
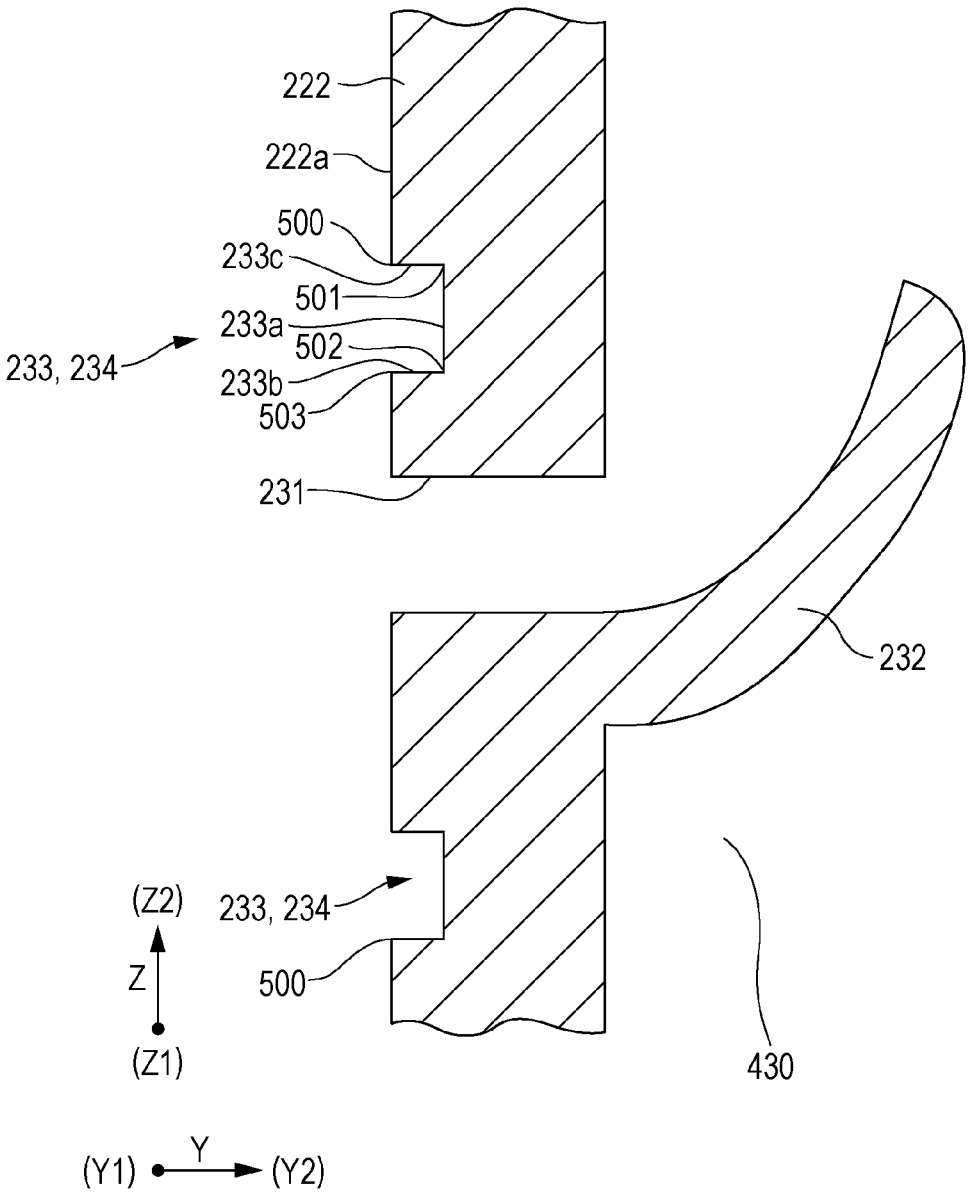
FIG. 9 is an enlarged cross-sectional view of a principal portion of the recording head according to Embodiment 1.
Figure 10:
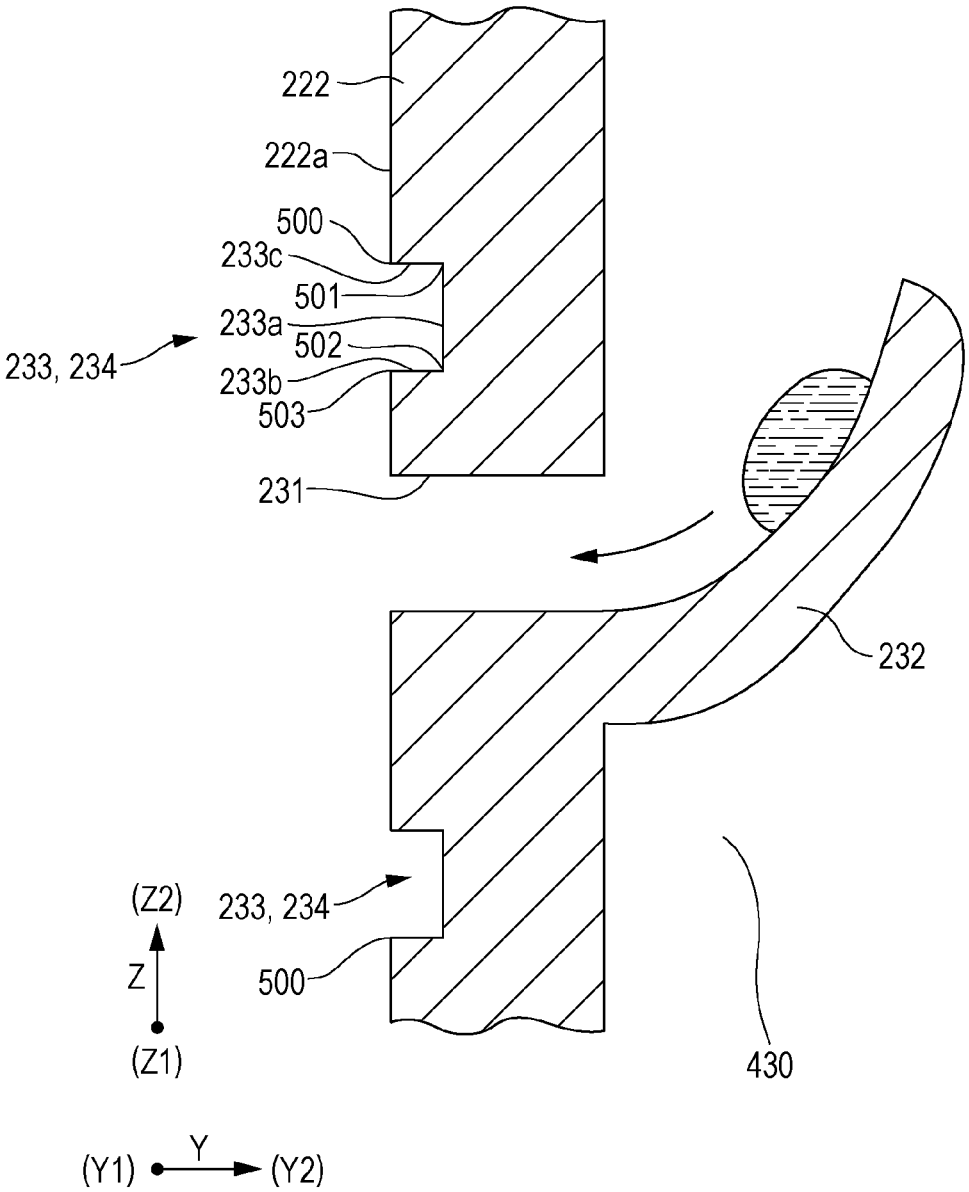
FIG. 10 is an enlarged cross-sectional view of a principal portion of the recording head according to Embodiment 1.
Figure 11A:
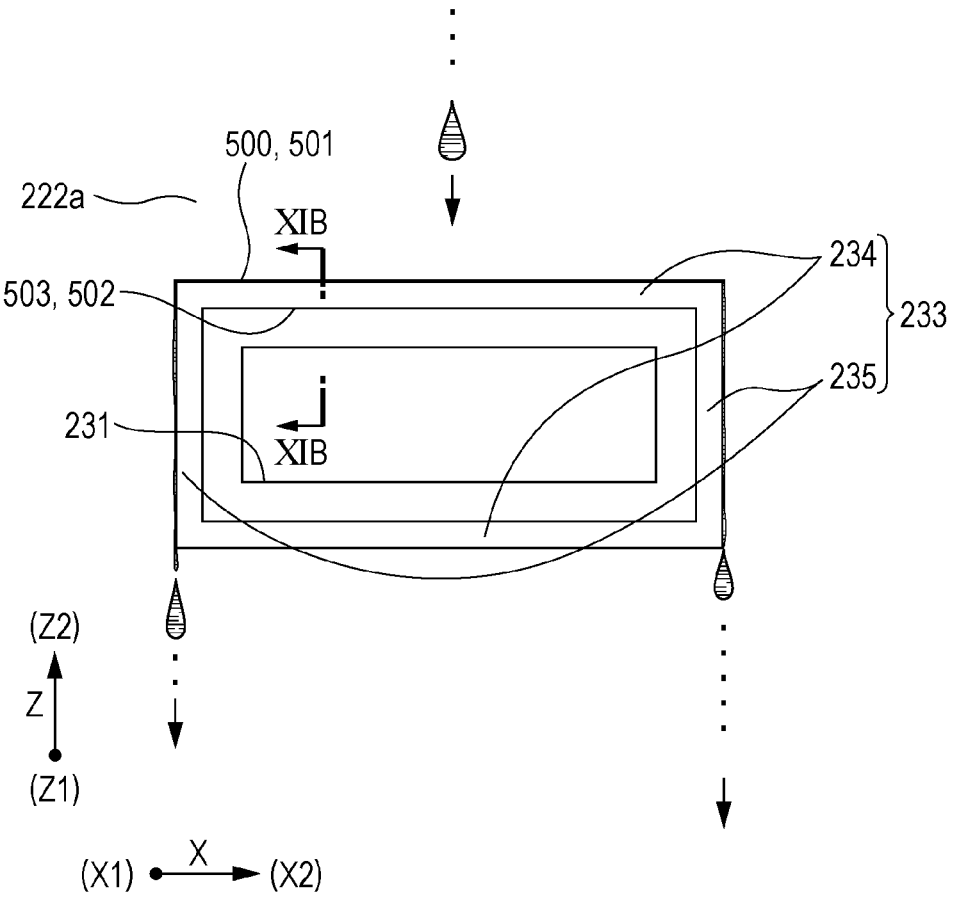
FIG. 11A is an enlarged plan view of a principal portion of the recording head according to Embodiment 1 and FIG. 11B is an enlarged cross-sectional view of the principal portion.
Figure 11B:
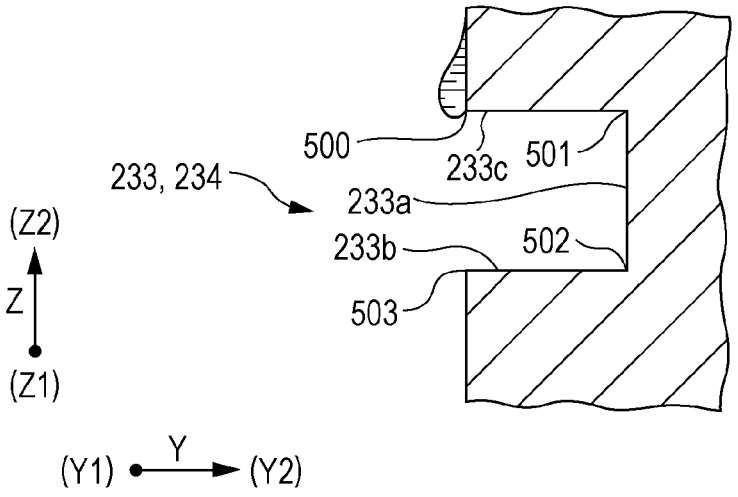

Here, the details of the other members constituting the ink jet type recording head of this embodiment will be described with reference to FIGS. 5A to 10. FIG. 5A is a plan view of the ink jet type recording head and FIG. 5B is an enlarged view of a principal portion thereof. FIG. 6 is a cross-sectional view taken along line VI-VI in FIG. 5A, FIG. 7 is a cross-sectional view taken along line VII-VII in FIG. 5A, and FIG. 8 is a cross-sectional view taken along line VIII-VIII in FIG. 5A. FIGS. 9 and 10 are enlarged views of the principal portion in FIG. 8. FIGS. 11A and 11B are enlarged views of the principal portion in FIG. 3.

The flow-path member 220 includes a flow-path member main body 221, a first covering member 222, and a second covering member 223, as illustrated in FIGS. 1 and 2. The first covering member 222 and the second covering member 223 are disposed on both lateral surfaces of the flow-path member main body 221, that is, both sides in the second direction Y in this embodiment. In this embodiment, a side on which the first covering member 222 is provided is referred to as a Y1 side in the second direction Y and a side on which the second covering member 223 is provided is referred to as a Y2 side. Furthermore, in this embodiment, the flow-path member 220 corresponds to a head casing body.

A liquid flow path 400 through which the ink is supplied from a liquid reservoiring unit (not illustrated) filled with the ink to the head main body 210 and through which the ink from the head main body 210 is recovered into the liquid reservoiring unit is provided in the flow-path member 220. Specifically, a supply flow path 410 and a recovery flow path 420 are provided in the flow-path member 220. One end of both the supply flow path 410 and the recovery flow path 420 is connected to the liquid reservoiring unit in a direct manner or in a manner using, for example, a tube and the other ends are connected to the head main body 210. The supply flow path 410 is an outward path through which the ink is supplied from the liquid reservoiring unit to the head main body 210. The supply flow path 410 communicates with the inflow path 44 of the head main body 210. The recovery flow path 420 is a return path through which the ink from the head main body 210 is recovered into the liquid reservoiring unit. The recovery flow path 420 communicates with the outflow path 45 of the head main body 210.

The supply flow path 410 is provided on one end portion side of the flow-path member 220 in the first direction X and the recovery flow path 420 is provided on the other end portion side of the flow-path member 220 in the first direction X. In this embodiment, one end portion side on which the supply flow path 410 is provided is referred to as an X2 side in the first direction X and the other end portion side on which the recovery flow path 420 is provided is referred to as an X1 side.

The supply flow path 410 includes an introduction port 411 connected to the liquid reservoiring unit in a direct manner or in a manner using, for example, a tube, a first flow path 412 communicating with the introduction port 411, a filter chamber 413 connected to the first flow path 412, and a second flow path 414 connecting the filter chamber 413 and the head main body 210, as illustrated in FIG. 6.

Both the first flow path 412 and the filter chamber 413 are formed in a grooved shape open to one surface side, that is, the Y1 side in this embodiment, of the flow-path member main body 221 in the second direction Y. The openings of both the first flow path 412 and the filter chamber 413 are sealed by the first covering member 222. One end of the second flow path 414 communicates with the filter chamber 413 and the other end is connected to the inflow path 44 (see FIG. 6) of the head main body 210. A filter 224 is provided in the filter chamber 413 to remove foreign matter, such as dust or air bubbles in the ink. The ink supplied to the filter chamber 413 through the first flow path 412 passes through the filter 224 and is supplied, through the second flow path 414, to the inflow path 44 of the head main body 210.

Such a filter 224 is a member for removing foreign matter, such as dust or air bubbles in the ink as liquid. For example, a sheet-shaped member which is formed by finely knitting fibers of, for example, metal or resins and has a plurality of micro-pores formed therein or a plate-shaped member which is formed of, for example, metal or resins and has a plurality of micro-pores passing therethrough can be used as the filter 224. Furthermore, nonwoven fabrics may be used as the filter 224. The material of the filter 224 is not particularly limited.

Meanwhile, the recovery flow path 420 is provided on the other end portion side, that is, the X2 side, of the flow-path member 220, which is the side opposite to the supply flow path 410 in the first direction X, as illustrated in FIG. 7. The recovery flow path 420 passes through both the Z1 side which is the liquid ejection surface 20*a* side in the third direction Z and the Z2 side which is opposite to the Z1 side.

Furthermore, both a first concave portion 225 and a second concave portion 226 are provided in the flow-path member main body 221, as illustrated in FIG. 8. The first concave portion 225 is open to one surface side in the second direction Y and the second concave portion 226 is open to the other surface side in the second direction Y. The first concave portion 225 and the second concave portion 226 are partitioned by a partitioning wall portion 227.

The opening of the first concave portion 225 of the flow-path member 220 is covered with first covering member 222. A first space portion 430 is formed in a portion between the first concave portion 225 and the first covering member 222.

The opening of the second concave portion 226 is covered with the second covering member 223. A second space portion 431 is formed in a portion between the second concave portion 226 and the second covering member 223.

The circuit substrate 250 is held in the second space portion 431. A communication hole 228 is provided on the head main body 210 side, that is, the Z1 side, of the flow-path member 220. The communication hole 228 causes the second space portion 431 to communicate with the Z1-side surface. The wiring substrate 121 of the head main body 210 is inserted through the communication hole 228 and connected to the circuit substrate 250 in the second space portion 431.

An external wiring connection hole 229 is provided on the Z2 side of the flow-path member 220. The external wiring connection hole 229 causes the second space portion 431 to communicate with the outside. The external wiring substrate 260 is inserted through the external wiring connection hole 229 and connected to the circuit substrate 250 in the second space portion 431. Furthermore, the external wiring connection hole 229 is sealed by a sealing member 280. As a result, entrance of ink through the external wiring connection hole 229 is prevented.

A printing signal from, for example, an external control circuit is supplied, as a driving signal, to the piezoelectric actuator 300 through the external wiring substrate 260, the circuit substrate 250, and the wiring substrate 121.

Since the atmosphere opening path of the head main body 210 described above communicates with the connection port 43, the atmosphere opening path communicates with the second space portion 431 through the communication hole 228 of the flow-path member 220, which communicates with the connection port 43.

Furthermore, a connection path 230 is provided in the partitioning wall portion 227 partitioning the first concave portion 225 and the second concave portion 226. The connection path 230 causes the first space portion 430 to communicate with the second space portion 431. As a result, the atmosphere opening path communicating with the second space portion 431 communicates with the first space portion 430 through the connection path 230.

In addition, an atmosphere opening port 231 is provided in the first covering member 222. The atmosphere opening port 231 passes through the first covering member 222 and causes the first space portion 430 to communicate with the outside. In other words, the atmosphere opening path of the head main body 210 communicates with the second space portion 431 of the flow-path member 220 through the communication hole 228. The second space portion 431 communicates with the first space portion 430 through the connection path 230. Furthermore, the first space portion 430 communicates with the outside through the atmosphere opening port 231. That is, the atmosphere opening path of the head main body 210 is open to the atmosphere, through the communication hole 228, the second space portion 431, the connection path 230, the first space portion 430, and the atmosphere opening port 231.

The ink jet type recording head 200 of this embodiment is disposed in a state where the third direction Z is set to be parallel to a vertical direction, that is, the Z1 side which is the liquid ejection surface 20*a* side is located on a lower side in the vertical direction.

The first space portion 430 communicating with the atmosphere opening port 231 extends further to the lower side in the vertical direction than the atmosphere opening port 231, and thus the ink entering through the atmosphere opening port 231 is reserved in the first space portion 430. In other words, the atmosphere opening port 231 is located further to the upper side than the lower end portion of the first space portion 430 in the vertical direction. That is, the atmosphere opening port 231 is located further to the Z2 side than the Z1-side end portion of the first space portion 430. Thus, even when the ink enters through the atmosphere opening port 231, the entering ink is reserved in the Z1 side which is the side located further to the lower side in the vertical direction than the atmosphere opening port 231 of the first space portion 430.

In this embodiment, the connection path 230 provided in the partitioning wall portion 227 is located further to the Z2 side, that is, the upper side in the vertical direction, than the atmosphere opening port 231. Accordingly, even when the ink enters the first space portion 430, the ink in the first space portion 430 can be prevented from entering the second space portion 431 through the connection path 230. In other words, even when the ink is reserved in the first space portion 430 and the liquid level of the ink moves to the upper side in the vertical direction, that is, the Z2 side in the third direction Z, the liquid level of the ink reaches the atmosphere opening port 231 prior to reaching the connection path 230. Thus, the ink is discharged to the outside through the atmosphere opening port 231. In other words, when the ink is reserved to the extent that the liquid level of the ink in the first space portion 430 reaches the atmosphere opening port 231, the ink exceeding this level is prevented from entering the first space portion 430 through the atmosphere opening port 231. As a result, it is possible to prevent the ink entering the first space portion 430 from entering in the second space portion 431 through the connection path 230. Since the circuit substrate 250 of this embodiment is held in the second space portion 431, electronic units, wiring, and the like which are provided in the circuit substrate 250, the external wiring substrate 260, and the wiring substrate 121 can be prevented from being damaged by the ink entering the second space portion 431. Furthermore, it is possible to prevent short-circuiting of the wiring of each substrate. In addition, although the atmosphere opening path of the head main body 210 communicates with the second space portion 431 through the communication hole 228, the ink is prevented from entering the second space portion 431. Thus, the ink can be prevented from entering the head main body 210. Incidentally, when the ink enters the atmosphere opening path of the head main body 210 and the ink enters, for example, the holding portion 31, there is a concern that the piezoelectric actuator 300 may be damaged. Furthermore, this results in a hindrance in the deformation of the piezoelectric actuator 300 due to the mass or viscosity of the ink applied to the piezoelectric actuator 300. Needless to say, when ink having conductivity is used, there is a concern that electrodes of the plurality of piezoelectric actuators 300 may be short-circuited. Furthermore, when the ink enters the space 95 between the compliance substrate 91 and the cover head 270, the deformation of the compliance portion is hindered due to the entering ink. As a result, changes in the pressure of the ink in the manifold 100 are not sufficiently absorbed and this has a negative effect on the ejection properties of the ink droplets. In this embodiment, the atmosphere opening path of the head main body 210 is open to the atmosphere. Accordingly, the holding portion 31 of the piezoelectric actuator 300 is open to the atmosphere, and thus the piezoelectric actuator 300 can be reliably driven. In addition, the compliance portion is deformed, and thus it is possible to suppress the generation of variation in discharge weights, which is caused by starting pressure changes at the time of driving the piezoelectric actuator 300. Furthermore, the atmosphere opening path of the head main body 210 is open to atmosphere through the communication hole 228, the second space portion 431, the connection path 230, the first space portion 430, and the atmosphere opening port 231. As a result, the ink is prevented from entering the atmosphere opening path, and thus it is possible to prevent failures, such as damage to the piezoelectric actuator 300, a reduction in displacement amount, and deterioration in the ejection properties due to the deformation failure of the compliance portion.

In this embodiment, a wall portion 232 is provided in the first space portion 430. The wall portion 232 extends from the Z1 side, that is, the lower side in the vertical direction, of the atmosphere opening port 231 of the first covering member 222 to the Z2 side, that is, the upper side in the vertical direction. In other words, the base end portion of the wall portion 232 is fixed to the first covering member 222 and the tip end portion thereof forms a free end at the position facing the atmosphere opening port 231. Since the wall portion 232 is provided as described above, the wall portion 232 can prevent entrance of ink, even when the ink enters through the atmosphere opening port 231. In other words, when the ink enters through the atmosphere opening port 231, the ink moves to the lower side in the vertical direction, along the surface of the wall portion 232, as described in FIG. 10. Thus, the ink flows to the outside through the atmosphere opening port 231.

In this embodiment, a corner portion is provided in a wall surface 222*a* of the first covering member 222, which is located on the outer side having the atmosphere opening port 231 formed thereon, as illustrated in FIGS. 9, 11A, and 11B. The corner portion is formed by both the wall surface 222*a* and a surface in a direction intersecting the third direction Z, that is, the plane direction of the wall surface 222*a*. In this embodiment, a groove portion 233 is provided in the wall surface 222*a* of the first covering member 222, having a concave shape surrounding the periphery of the atmosphere opening port 231. Thus, the corner portion is formed by the groove portion 233. In this case, the groove portion 233 includes two first groove portions 234 extending in the first direction X and two second groove portions 235 extending in the third direction Z. End portions of both the two first groove portions 234 and the two second groove portions 235 are connected to each other. Thus, when viewed from the second direction Y, the first groove portions 234 and the second groove portions 235 form a rectangular shape. The atmosphere opening port 231 is opened in the inner side of the groove portion 233.

Such a groove portion 233 includes a bottom surface 233*a*, a first lateral surface 233*b*, and a second lateral surface 233*c*. The first lateral surface 233*b* is perpendicular to both the bottom surface 233*a* and wall surface 222*a* and is located on the atmosphere opening port 231 side. The second lateral surface 233*c* is perpendicular to both the bottom surface 233*a* and the wall surface 222*a* and is located on a side opposite to the atmosphere opening port 231. Accordingly, the cross-sectional surface of the groove portion 233 has a rectangular shape.

A first corner portion 500 which is a corner portion of this embodiment is constituted by the second lateral surface 233*c* and the wall surface 222*a*. In other words, the first corner portion 500 of this embodiment is constituted by the wall surface 222*a* and the second lateral surface 233*c* perpendicular to the wall surface 222*a* such that the first corner portion 500 is formed bent at approximately 90 degrees. In this embodiment, since the first corner portion 500 which is a corner portion is formed by the groove portion 233, a second corner portion 501, a third corner portion 502, and a fourth corner portion 503 are provided further to the atmosphere opening port 231 side than the first corner portion 500. The second corner portion 501 is constituted by the second lateral surface 233*c* and the bottom surface 233*a*. The third corner portion 502 is constituted by the bottom surface 233*a* and the first lateral surface 233*b*. The fourth corner portion 503 is constituted by the first lateral surface 233*b* and the wall surface 222*a*. In other words, since the groove portion 233 having a concave shape open to the wall surface 222*a* is formed, four corner portions, in total, which are the first corner portion 500, the second corner portion 501, the third corner portion 502, and the fourth corner portion 503 are formed. In this embodiment, the first corner portion 500 located at the position farthest from the atmosphere opening port 231 corresponds to the corner portion disclosed in the claims.

In a direction, that is, the first direction X, perpendicular to the third direction Z which is the vertical direction in the plane of the wall surface 222*a*, the first corner portion 500 formed by the first groove portion 234 located on the Z2 side, that is, the upper side in the vertical direction, of the atmosphere opening port 231 is formed to have the width greater than the width of the atmosphere opening port 231 in the first direction X. In other words, the first corner portion 500 formed by the first groove portion 234 located on the Z2 side, that is, the upper side in the vertical direction, of the atmosphere opening port 231 is formed to have the width having a value in which, when the atmosphere opening port 231 is projected onto the first corner portion 500, along the wall surface 222*a* toward the Z2 side, that is, the upper side in the vertical direction, the atmosphere opening port 231 is smaller than the value of first corner portion 500. Furthermore, in the vertical direction of the atmosphere opening port 231, the first corner portion 500 of this embodiment extends along a straight line in the first direction X, that is, the first corner portion 500 horizontally extends without inclination to the third direction Z. In this embodiment, since the first corner portion 500 is formed by the groove portion 233 surrounding the atmosphere opening port 231, as described above, the first corner portion 500 satisfies the conditions described above.

The first corner portion 500 is provided in the wall surface 222*a* in which the atmosphere opening port 231 is opened. Accordingly, when the ink applied to the wall surface 222*a* moves along the wall surface 222*a* to the lower side in the vertical direction, the ink flows along the first corner portion 500. As a result, the ink can be prevented from entering the atmosphere opening port 231. In other words, the ink applied to the surface of the wall surface 222*a* comes into contact with the first corner portion 500 of the first groove portion 234 on the Z2 side of the atmosphere opening port 231, that is, the upper side in the vertical direction, as illustrated in FIGS. 11A and 11B. In this case, the ink does not enter the groove portion 233 and moves along the first corner portion 500 due to surface tension. Subsequently, the ink moves along the first corner portion 500 in the second groove portion 235 which continuously extends from the first groove portion 234, then the ink flows further to the Z1 side, from the Z1 side, that is, the lower side in the vertical direction, of the first corner portion 500 of the second groove portion 235. Accordingly, the ink applied to the wall surface 222*a* moves along the first corner portion 500, and thus the ink is prevented from entering through the atmosphere opening port 231.

Furthermore, since the first corner portion 500 of this embodiment is formed by the groove portion 233, it is not necessary to provide a convex portion protruding from the wall surface 222*a*. As a result, the width of the ink jet type recording head 200 in the second direction Y can be reduced.

Since the groove portion 233 is provided in this embodiment, the second corner portion 501, the third corner portion 502, and the fourth corner portion 503 are further provided in a portion between the first corner portion 500 and the atmosphere opening port 231. Accordingly, even when the ink gets over the first corner portion 500, the ink can move along, for example, the second corner portion 501, the third corner portion 502, and the fourth corner portion 503. As a result, the ink can be prevented from entering through the atmosphere opening port 231. Particularly, in this embodiment, since the first corner portion 500, the second corner portion 501, the third corner portion 502, and the fourth corner portion 503 are formed by the groove portion 233, the ink getting over the first corner portion 500 is held in the groove portion 233. The ink is held in the groove portion 233, as described above, and this also can prevent the ink from entering through the atmosphere opening port 231.

Since the first corner portion 500 of this embodiment is constituted by the wall surface 222*a* and the second lateral surface 233*c* perpendicular to the wall surface 222*a*, the first corner portion 500 is formed bent at 90 degrees. However, the angle of the first corner portion 500 is not limited thereto. The angle of the first corner portion 500 may be an acute angle or an obtuse angle. However, it is preferable that the angle between the wall surface 222*a* and the second lateral surface 233*c*, both of which constitute the first corner portion 500, be equal to or less than 90 degrees. The reason for this is as follows. When the angle of the first corner portion 500 constituted by the wall surface 222*a* and the second lateral surface 233*c* is greater than 90 degrees, that is, the angle is a so-called obtuse angle, the ink easily gets over the first corner portion 500. Needless to say, this is also common to the second corner portion 501, the third corner portion 502, and the fourth corner portion 503.

In this embodiment, the first corner portion 500 continuously extends along the periphery of the atmosphere opening port 231. Thus, not only in a case where the liquid ejection surface 20*a* is disposed to be directed vertically downward, but also in a case where the liquid ejection surface 20*a* is disposed to be directed vertically upward or sideways, perpendicular to the vertical direction, when the ink applied to the wall surface 222*a* moves along the wall surface 222*a*, the first corner portion 500 can prevent the ink from entering through the atmosphere opening port 231. In other words, since the first corner portion 500 extends along the periphery of the atmosphere opening port 231, the ink jet type recording head 200 can be used in any angular position.

Incidentally, since the first corner portion 500 is provided in the this embodiment, the first corner portion 500 can prevent the ink moving along the wall surface 222*a* from entering through the atmosphere opening port 231. However, there is a concern that, for example, the ink getting over the first corner portion 500, the second corner portion 501, the third corner portion 502, and the fourth corner portion 503 or the ink directly dropping into the atmosphere opening port 231 may enter through the atmosphere opening port 231. However, as described above, since the wall portion 232 is provided in this embodiment, the ink getting over the groove portion 233 or the ink directly dropping into the atmosphere opening port 231 can be prevented from entering the first space portion 430. Furthermore, since the ink which gets over the wall portion 232 and enters the first space portion 430 is reserved in the first space portion 430, the ink can be prevented from entering the second space portion 431 through the connection path 230. As a result, even when the ink enters the first space portion 430, electronic units, wiring, and the like which are provided in the circuit substrate 250, the external wiring substrate 260, and the wiring substrate 121, all of which are held in the second space portion 431, can be prevented from being damaged or short-circuited by the ink. Furthermore, it is possible to prevent the ink from entering through the atmosphere opening path of the head main body 210.

In such an ink jet type recording head 200 of this embodiment, the ink from the liquid reservoiring unit (not illustrated) passes through the supply flow path 410 of the flow-path member 220 and is supplied through the inflow path 44 of the head main body 210. Next, the inner portion of the head main body 210 is filled with the ink until the ink reaches the nozzle openings 21, and then ink droplets are ejected through the nozzle openings 21 in such a manner that the piezoelectric actuator 300 is driven in accordance with the recording signals from the driving circuit 120. Furthermore, the ink introduced into the manifold 100 in the head main body 210 flows to the recovery flow path 420 of the flow-path member 220, through the outflow path 45, and then the ink returns to the liquid reservoiring unit through the recovery flow path 420. In other words, so-called circulation of ink is performed in such a manner that the ink in the liquid reservoiring unit is supplied to the head main body 210 through the supply flow path 410, and then the ink is recovered from the head main body 210 to the liquid reservoiring unit through the recovery flow path 420.

The ink jet type recording head 200 in which the ink circulates is exemplified in this embodiment. However, the type of the recording head is not limited thereto. An ink jet type recording head in which the ink does not circulate, that is, the ink is only supplied from a liquid reservoiring unit to the ink jet type recording head 200 may be applied.

Embodiment 2

Figure 12:
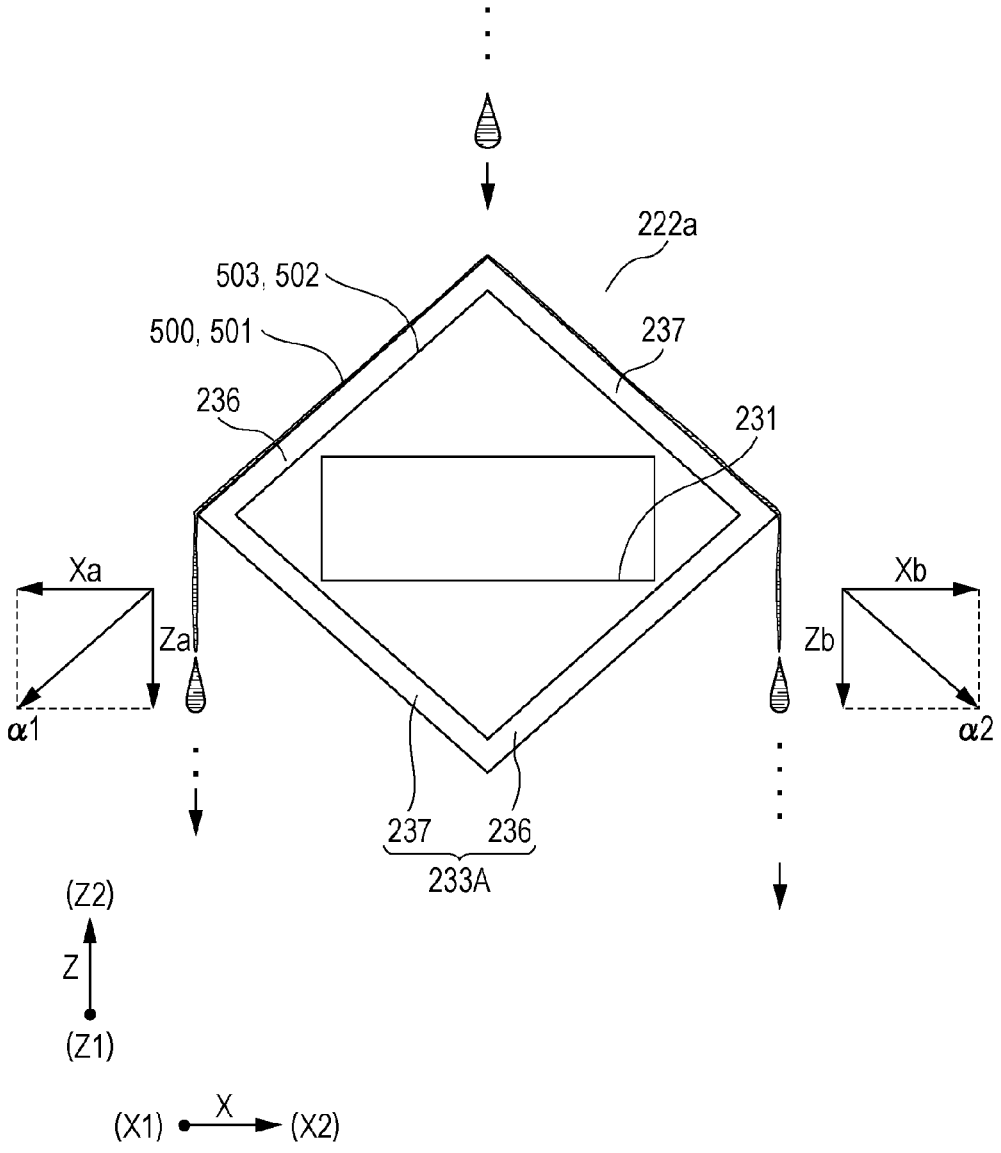
FIG. 12 is an enlarged plan view of a principal portion of a recording head according to Embodiment 2.

FIG. 12 is a plan view illustrating a principal portion of a wall surface of an ink jet type recording head as an example of a liquid ejecting head according to Embodiment 2 of the invention. The same reference numerals are given to members having the same configurations as those in Embodiment 1 described above. The descriptions thereof will not be repeated.

A groove portion 233A of Embodiment 2 extends along the periphery of the atmosphere opening port 231 of the wall surface 222*a*, as illustrated in FIG. 12. The groove portion 233A includes two third groove portions 236 and two fourth groove portions 237. The third groove portion 236 extends in a first vector direction α1 including both a component Xa in the first direction X and a component Za in the third direction Z. The fourth groove portion 237 extends in a second vector direction α2 including both a component Xb in the first direction X and a component Zb in the third direction Z. End portions of both the third groove portions 236 and the fourth groove portions 237 are connected to each other.

Similarly to Embodiment 1 described above, such a groove portion 233A has the bottom surface 233*a*, the first lateral surface 233*b*, and the second lateral surface 233*c*. Therefore, the first corner portion 500, the second corner portion 501, the third corner portion 502, and the fourth corner portion 503 are provided.

In other words, the first corner portion 500 extending in both the first vector direction α1 and the second vector direction α2 is formed on the Z2 side, that is, the upper side in the vertical direction, of the atmosphere opening port 231. In a direction, that is, the second direction Y, perpendicular to the third direction Z which is the vertical direction in the plane of the wall surface 222*a*, the first corner portion 500 provided on the upper side of the atmosphere opening port 231 in the vertical direction is formed to have a width greater than the width of the atmosphere opening port 231 in the second direction Y.

In the groove portion 233A having such a configuration, the ink applied to the wall surface 222*a* flows along the first corner portions 500 of both the third groove portion 236 and the fourth groove portion 237 which are located further to the Z2 side, that is, the upper side in the vertical direction, than the atmosphere opening port 231. In other words, the ink applied to the first corner portion 500 flows along the first corner portion 500 in both the first vector direction α1 and the second vector direction α2. The ink flows, on the wall surface 222*a*, from the connection portion between the third groove portion 236 and the fourth groove portion 237 to the Z1 side, that is, the lower side in the vertical direction. Accordingly, the ink applied to the wall surface 222*a* can be prevented from entering the first space portion 430 through the atmosphere opening port 231.

In other words, in this embodiment, the third groove portion 236 and the fourth groove portion 237 extend in the first vector direction α1 and the second vector direction α2, both of which intersect with both the third direction Z, that is, the vertical direction, and the first direction X. Thus, the ink is likely to flow in the first vector direction α1 or the second vector direction α2, along the groove portion 233A, that is, flow along the first corner portion 500 formed by the groove portion 233A. As a result, it is possible to further prevent the ink from getting over the first corner portion 500 and moving to the atmosphere opening port 231 side.

In this embodiment, also, the groove portion 233A continuously extends to surround the periphery of the atmosphere opening port 231. Thus, even when the ink jet type recording head 200 is used in any angular position, that is, even when the ink jet type recording head 200 is used in angular positions other than the angular position in which the liquid ejection surface 20*a* is directed vertically downward, the ink can be prevented from entering through the atmosphere opening port 231.

Embodiment 3

Figure 13:
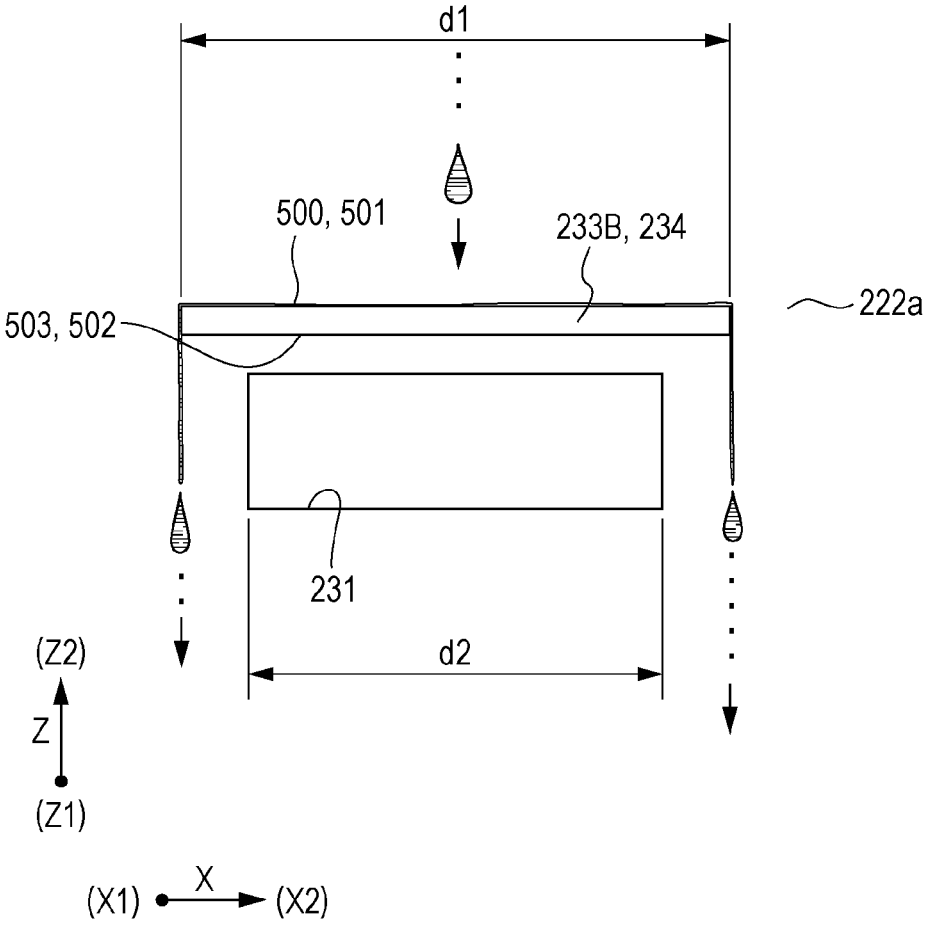
FIG. 13 is an enlarged plan view of a principal portion of a recording head of Embodiment 3.

FIG. 13 is an enlarged plan view of a principal portion of a wall surface of an ink jet type recording head as an example of a liquid ejecting head according to Embodiment 3 of the invention. The same reference numerals are given to members having the same configurations as those in the embodiments described above. The descriptions thereof will not be repeated.

A groove portion 233B of this embodiment is constituted by only one first groove portion 234 on the upper side, that is, the Z2 side, of the atmosphere opening port 231 in the third direction Z, that is, the vertical direction, as illustrated in FIG. 13.

The width d1 of such a groove portion 233B in the first direction X is greater than the width d2 of the atmosphere opening port 231. Similarly to Embodiment 1 described above, the groove portion 233B has the bottom surface 233*a*, the first lateral surface 233*b*, and the second lateral surface 233*c*. Therefore, the first corner portion 500, the second corner portion 501, the third corner portion 502, and the fourth corner portion 503 are formed.

In other words, the first corner portion 500 is provided on at least the upper side of the atmosphere opening port 231 in the vertical direction. In a direction, that is, the second direction Y, perpendicular to the third direction Z which is the vertical direction in the plane of the wall surface 222*a*, the width of the first corner portion 500 is formed to be greater than the width of the atmosphere opening port 231 in the second direction Y.

Accordingly, the ink applied further to the upper side of the wall surface 222*a* than the atmosphere opening port 231 flows along the first corner portion 500. As a result, the ink can be prevented from entering through the atmosphere opening port 231. In addition, the ink applied further to the lower side of the wall surface 222*a* than the atmosphere opening port 231 flows to the side opposite to the atmosphere opening port 231 side. As a result, the ink does not enter through the atmosphere opening port 231. The ink applied to parts of the wall surface 222*a*, which are portions on both sides of the atmosphere opening port 231 in the first direction X, flows vertically downward. As a result, the ink does not enter through the atmosphere opening port 231.

When the width of the first corner portion 500 is set to be smaller than that of the atmosphere opening port 231, that is, when the width d1 of the first corner portion 500 is smaller than the width d2 of the atmosphere opening port 231, the ink which moves along the first corner portion 500 and flows from the end portion of the first corner portion 500 enters through atmosphere opening port 231.

For this reason, the first corner portion 500 may be configured as follows. In the direction, that is, the first direction X, perpendicular to the third direction Z which is the vertical direction in the plane of the wall surface 222*a*, the first corner portion 500 provided on the Z2 side, that is, the upper side in the vertical direction, of the atmosphere opening port 231 has a width greater than that of the atmosphere opening port 231 in the first direction X.

The first corner portion 500 is located on the upper side of the atmosphere opening port 231 in the vertical direction. Thus, in a case where the liquid ejection surface 20*a* of the ink jet type recording head 200 is disposed to be directed vertically upward or sideways, perpendicular to the vertical direction, the ink applied to the wall surface 222*a* can be prevented from entering through the atmosphere opening port 231, in such a manner that the groove portion 233B having the first corner portion 500 is provided on the upper side of the atmosphere opening port 231 in the vertical direction, in accordance with the direction of the ink jet type recording head 200.

Embodiment 4

Figure 14A:
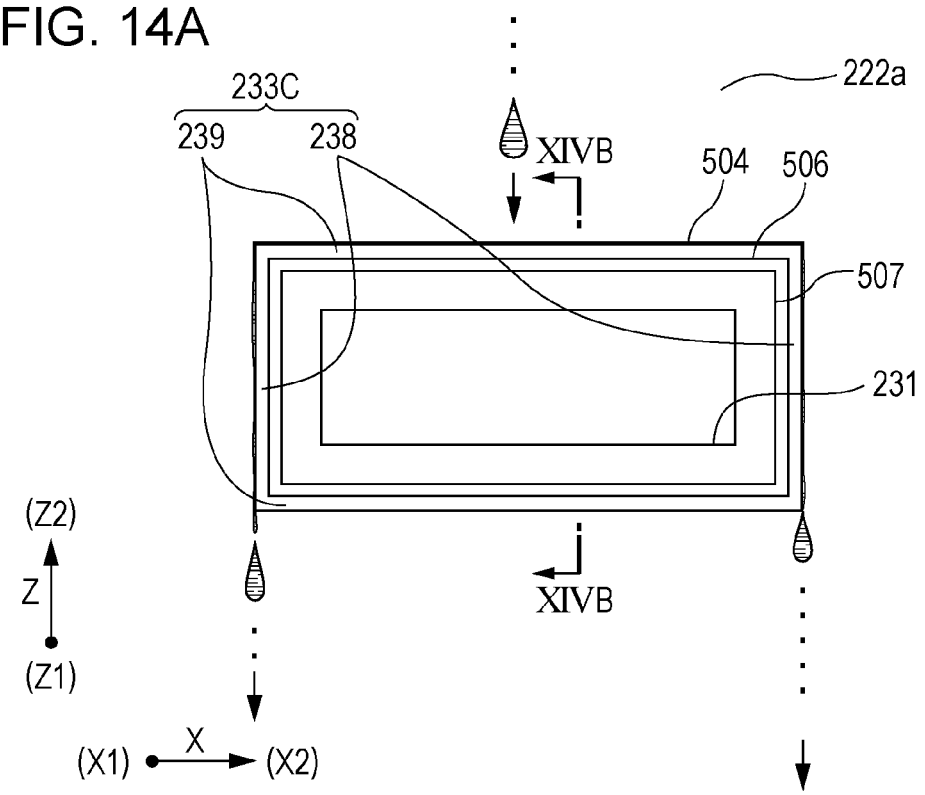
FIG. 14A is an enlarged plan view of a principal portion of a recording head according to Embodiment 4 and FIG. 14B is an enlarged cross-sectional view of the principal portion.
Figure 14B:
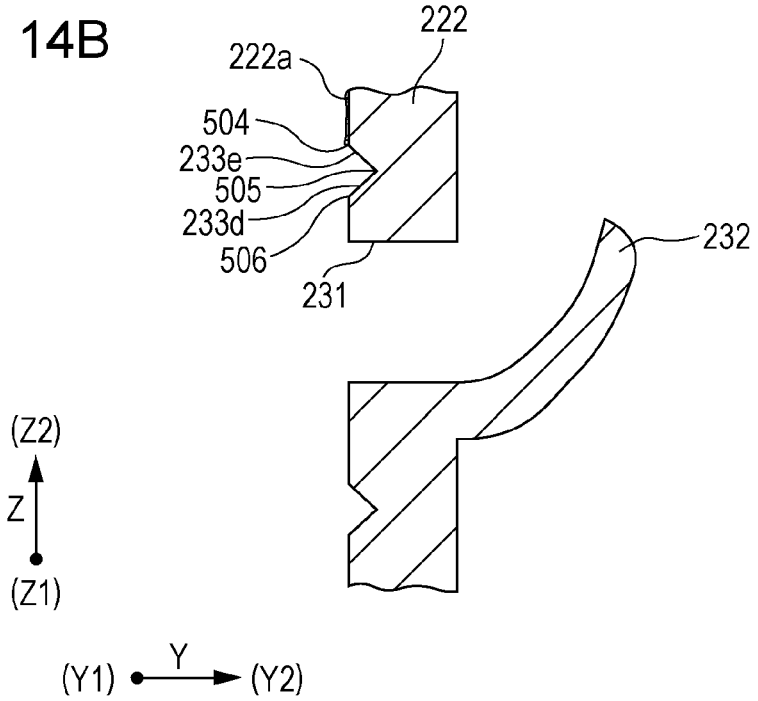

FIG. 14A is an enlarged plan view of a principal portion of a wall surface of an ink jet type recording head as an example of a liquid ejecting head according to Embodiment 4 of the invention and FIG. 14B is a cross-sectional view taken along line XIVB-XIVB. The same reference numerals are given to members having the same configurations as those in the embodiments described above. The descriptions thereof will not be repeated.

A groove portion 233C is constituted by both two fifth groove portions 238 extending in the third direction Z and two sixth groove portions 239 extending in the first direction X, in a state where end portions of both the fifth groove portions 238 and the sixth groove portions 239 are connected to surround the atmosphere opening port 231, as illustrated in FIG. 14A. In other words, when viewed from the second direction Y, the groove portion 233C continuously extends to form a rectangular shape surrounding the atmosphere opening port 231.

The groove portion 233C includes a third lateral surface 233*d* and a fourth lateral surface 233*e*. The third lateral surface 233*d* is provided on the atmosphere opening port 231 side and forms an obtuse angle with the wall surface 222*a*. The fourth lateral surface 233*e* is provided on a side opposite to the atmosphere opening port 231, forms an obtuse angle with the wall surface 222*a*, and intersects the third lateral surface 233*d*. In other words, the cross-sectional surface of the groove portion 233C has a triangular shape, as illustrated in FIG. 14B. Such a groove portion 233C includes a fifth corner portion 504, a sixth corner portion 505, and a seventh corner portion 506. The fifth corner portion 504 is formed by the wall surface 222*a* and the fourth lateral surface 233*e*. The sixth corner portion 505 is formed by the third lateral surface 233*d* and the fourth lateral surface 233*e*. The seventh corner portion 506 is formed by the third lateral surface 233*d* and the wall surface 222*a*. In this embodiment, the fifth corner portion 504 corresponds to the corner portion disclosed in the claims.

Even in such a configuration, since the ink applied to the wall surface 222*a* flows along the fifth corner portion 504, similarly to Embodiment 1 described above, the ink can be prevented from entering through the atmosphere opening port 231. Furthermore, three corner portions which are the fifth corner portion 504, the sixth corner portion 505, and the seventh corner portion 506 are provided by the groove portion 233C. Thus, even when the ink gets over the fifth corner portion 504, the ink is held by the other corner portions, that is, the sixth corner portion 505 and the seventh corner portion 506. As a result, the ink can be prevented from entering through the atmosphere opening port 231. In addition, since the ink getting over the fifth corner portion 504 is reserved and held by the groove portion 233C, it is possible to further prevent the ink from entering through the atmosphere opening port 231.

Such a groove portion 233C can be applied to Embodiment 2 or 3 described above.

Embodiment 5

Figure 15A:
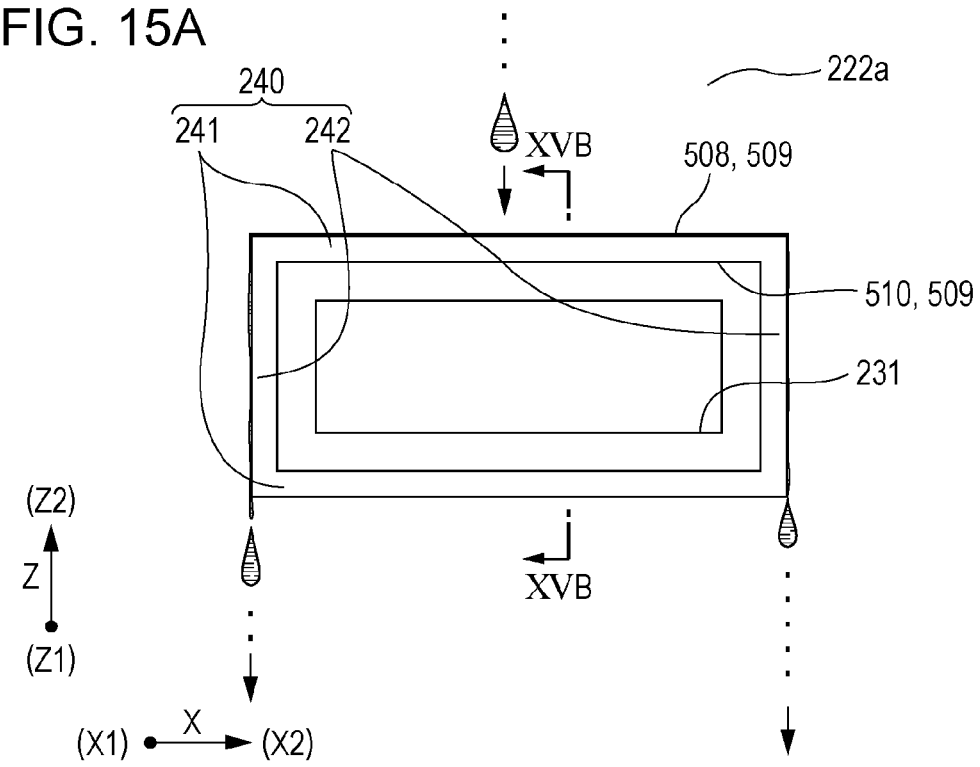
FIG. 15A is an enlarged plan view of a principal portion of a recording head according to Embodiment 5 and FIG. 15B is an enlarged cross-sectional view of the principal portion.
Figure 15B:
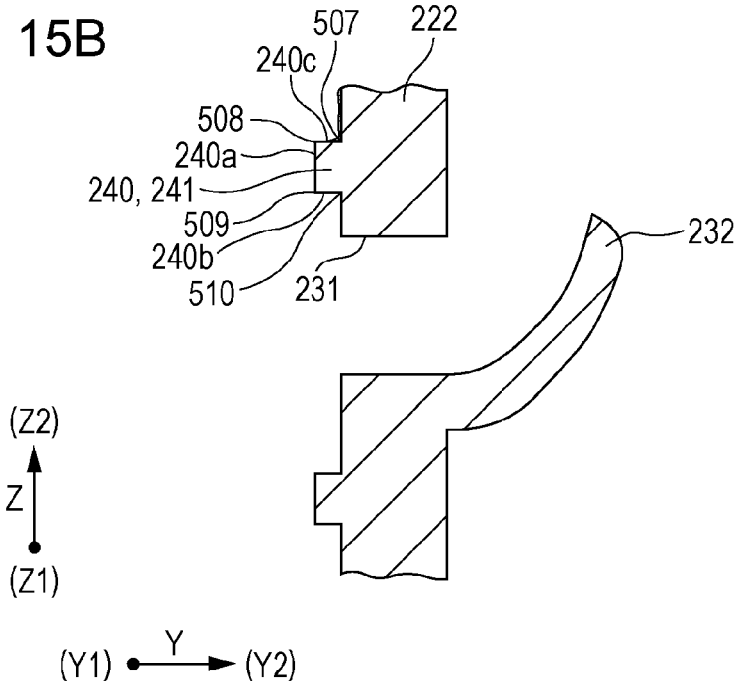

FIG. 15A is an enlarged plan view of a principal portion of a wall surface of an ink jet type recording head as an example of a liquid ejecting head according to Embodiment 5 of the invention and FIG. 15B is a cross-sectional view taken along line XVB-XVB. The same reference numerals are given to members having the same configurations as those in the embodiments described above. The descriptions thereof will not be repeated.

A convex portion 240 is formed on the wall surface 222*a* to surround the periphery of the atmosphere opening port 231, as illustrated in FIGS. 15A and 15B. The convex portion 240 is constituted by two first convex portions 241 extending in the first direction X and two second convex portions 242 extending in the third direction Z, in a state where end portions of the first convex portions 241 and the second convex portions 242 are connected to each other. In this embodiment, the two first convex portions 241 are disposed on the upper side and the lower side of the atmosphere opening port 231 in the vertical direction and the two second convex portions 242 are disposed on both sides, that is, the X1 side and X2 side, of the atmosphere opening port 231. In other words, when viewed from the second direction Y, the convex portion 240 continuously extends to form a rectangular shape surrounding the atmosphere opening port 231.

Such a convex portion 240 includes an end surface 240*a* in a protruding state, a first lateral surface 240*b* on the atmosphere opening port 231 side, and a second lateral surface 240*c* on a side opposite to the atmosphere opening port 231. In other words, the cross-sectional surface of the convex portion 240 has a rectangular shape, as illustrated in FIG. 15B.

Such a convex portion 240 includes a eighth corner portion 507, a ninth corner portion 508, a tenth corner portion 509, and an eleventh corner portion 510. The eighth corner portion 507 is formed by the wall surface 222*a* and the second lateral surface 240*c*. The ninth corner portion 508 is formed by the second lateral surface 240*c* and the end surface 240*a*. The tenth corner portion 509 is formed by the end surface 240*a* and the first lateral surface 240*b*. The eleventh corner portion 510 is formed by the first lateral surface 240*b* and the wall surface 222*a*. In this embodiment, the eighth corner portion 507 corresponds to the corner portion in the claims.

Incidentally, each of the first lateral surface 240*b* and the second lateral surface 240*c* makes a right angle with the wall surface 222*a*. The end surface 240*a* makes a right angle with the first lateral surface 240*b* and the second lateral surface 240*c*. It is preferable that the angle between the second lateral surface 240*c* and the wall surface 222*a* which form the eighth corner portion 507 of this embodiment be a equal to or smaller than 90 degrees. As a result, it is difficult for the ink to get over the eighth corner portion 507.

The eighth corner portion 507 is formed by the convex portion 240, and thus the ink applied to the Z2 side of the wall surface 222*a*, which is the side located further to the upper side in the vertical direction than the atmosphere opening port 231, comes into contact with the eighth corner portion 507 of the first convex portion 241, which is located on the Z2 side, that is, the upper side of the atmosphere opening port 231 in the vertical direction. Subsequently, the ink in contact with the eighth corner portion 507 moves along the eighth corner portion 507, due to capillary action, and then, the ink flows further to the Z1 side, from the Z1 side, that is, the lower side in the vertical direction, of the eighth corner portion 507 of the second convex portion 242. Accordingly, the ink applied to the wall surface 222*a* moves along the eighth corner portion 507, and thus the ink can be prevented from entering through the atmosphere opening port 231. Particularly, since the eighth corner portion 507 is formed by the convex portion 240 of this embodiment, it is difficult for the ink applied to the wall surface 222*a* to get over the convex portion 240. As a result, it is difficult for the ink to get over the eighth corner portion 507, and thus the ink can be prevented from entering through the atmosphere opening port 231.

In this embodiment, the eighth corner portion 507 continuously extends along the periphery of the atmosphere opening port 231. Thus, not only in a case where the liquid ejection surface 20*a* is disposed directed vertically downward, but also in a case where the liquid ejection surface 20*a* is disposed directed vertically upward or sideways, perpendicular to the vertical direction, when the ink applied to the wall surface 222*a* moves along the wall surface 222*a*, the eighth corner portion 507 can prevent the ink from entering through the atmosphere opening port 231. In other words, since the eighth corner portion 507 extends along the periphery of the atmosphere opening port 231, the ink jet type recording head 200 can be used in any angular position.

Figure 16A:
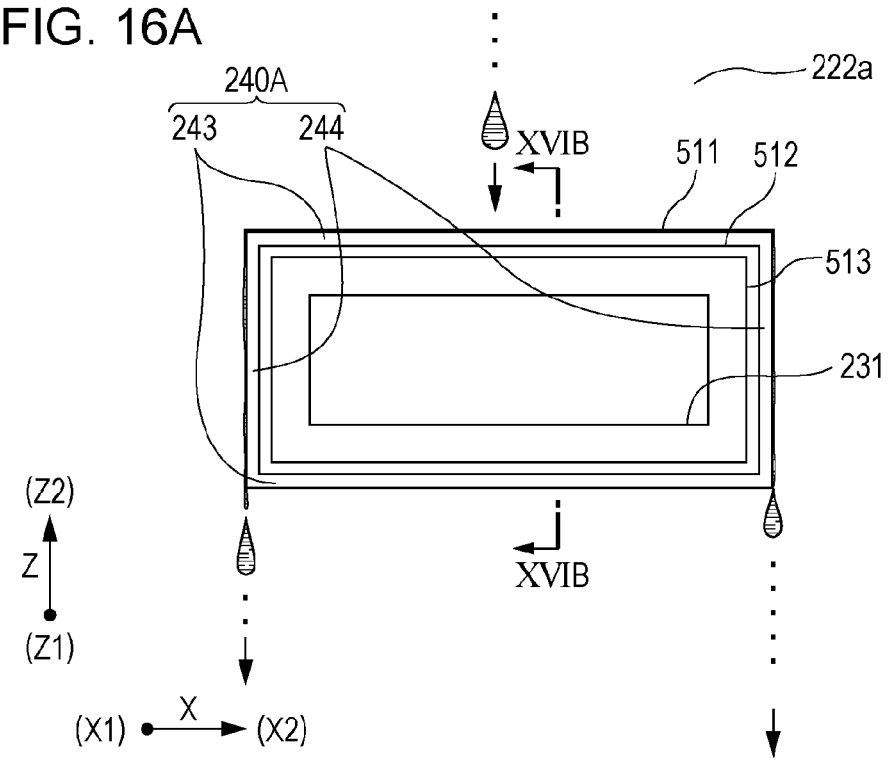
FIG. 16A is an enlarged plan view of a modification example of Embodiment 5 and FIG. 16B is an enlarged cross-sectional view.
Figure 16B:
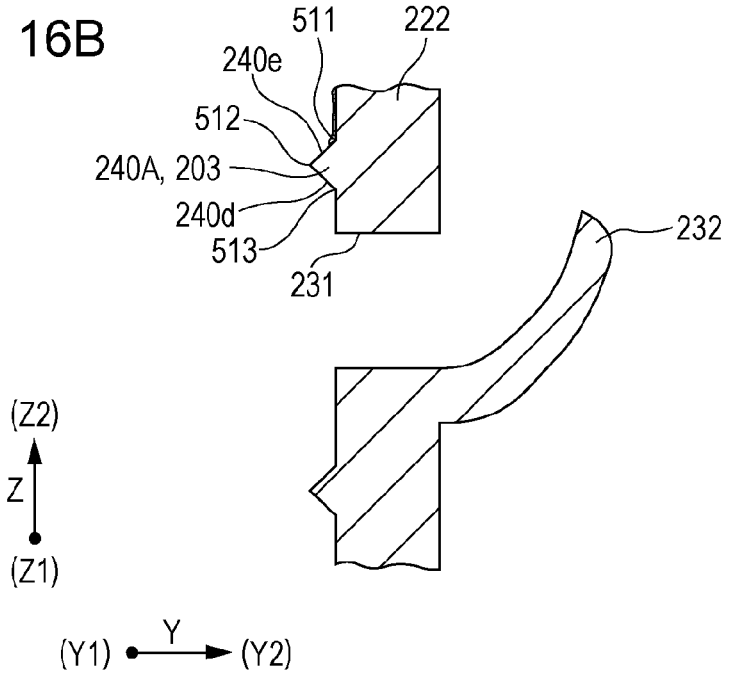

The shape of the cross-sectional surface of the convex portion 240 is not limited to being a rectangular shape. The cross section may have a triangular shape or a polygonal shape, for example, a pentagonal shape or another shape. Here, a modification of the convex portion will be described with reference to FIGS. 16A and 16B. FIG. 16A is an enlarged plan view of a principal portion of a wall surface, which illustrates the modification example of the convex portion according to Embodiment 5 of the invention. FIG. 16B is a cross-sectional view taken along line XVIB-XVIB.

A convex portion 240A is formed on the wall surface 222*a*, as illustrated in FIGS. 16A and 16B. The convex portion 240A is constituted by two third convex portions 243 extending in the first direction X and two fourth convex portions 244 extending in the third direction Z, in a state where end portions of the third convex portions 243 and the fourth convex portions 244 are connected to each other. In this embodiment, the two third convex portions 243 are disposed on the upper side and the lower side of the atmosphere opening port 231 in the vertical direction and the two fourth convex portions 244 are disposed on both sides, that is, the X1 side and X2 side, of the atmosphere opening port 231. In other words, when viewed from the second direction Y, the convex portion 240A continuously extends to form a rectangular shape surrounding the atmosphere opening port 231.

Such a convex portion 240A includes a third lateral surface 240*d* and a fourth lateral surface 240*e*. The third lateral surface 240*d* is provided on the atmosphere opening port 231 side and forms an obtuse angle with the wall surface 222*a*. The fourth lateral surface 240*e* is provided on a side opposite to the atmosphere opening port 231, forms an obtuse angle with the wall surface 222*a*, and intersects with the third lateral surface 240*d*. In other words, the cross-sectional surface of the convex portion 240A has a triangular shape, as illustrated in FIG. 16B.

Such a convex portion 240A includes a twelfth corner portion 511, a thirteenth corner portion 512, and a fourteenth corner portion 513. The twelfth corner portion 511 is formed by the wall surface 222*a* and the fourth lateral surface 240*e*. The thirteenth corner portion 512 is formed by the third lateral surface 240*d* and the fourth lateral surface 240*e*. The fourteenth corner portion 513 is formed by the third lateral surface 240*d* and the wall surface 222*a*. In this embodiment, the twelfth corner portion 511 corresponds to the corner portion disclosed in the claims.

Even in such a configuration, the ink applied to the wall surface 222*a* flows along the twelfth corner portion 511, similarly to the case of the eighth corner portion 507. As a result, the ink can be prevented from entering through the atmosphere opening port 231.

Embodiment 6

Figure 17A:
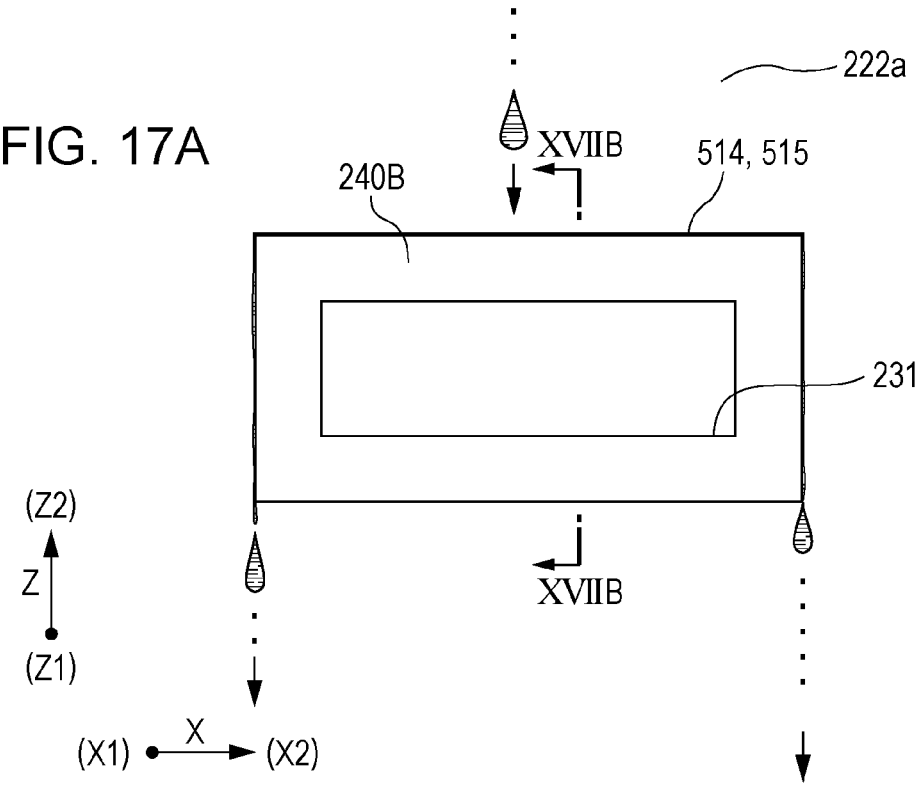
FIG. 17A is an enlarged plan view of a principal portion of a recording head according to Embodiment 6 and FIG. 17B is an enlarged cross-sectional view of the principal portion.
Figure 17B:
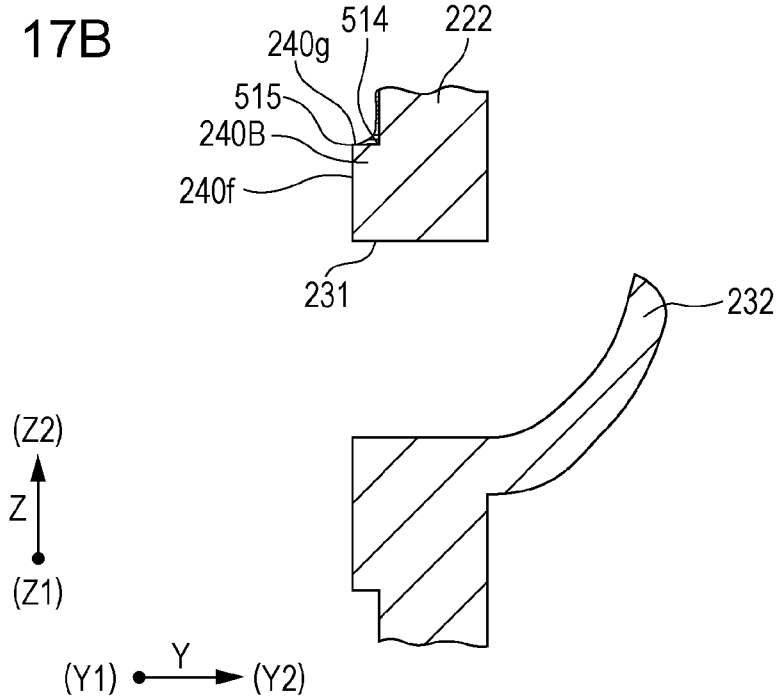

FIG. 17A is an enlarged plan view of a principal portion of a wall surface of an ink jet type recording head as an example of a liquid ejecting head according to Embodiment 6 of the invention and FIG. 17B is a cross-sectional view taken along line XVIIB-XVIIB. The same reference numerals are given to members having the same configurations as those in the embodiments described above. The descriptions thereof will not be repeated.

A convex portion 240B is provided on the wall surface 222*a*, as illustrated in FIGS. 17A and 17B. The atmosphere opening port 231 is open in an end surface 240*f* of the convex portion 240B, which is the protruding surface. In other words, the convex portion 240B includes the end surface 240*f* in a protruding state and a fifth lateral surface 240*g*. The fifth lateral surface 240*g* is perpendicular to both the end surface 240*f* and the wall surface 222*a*. The convex portion 240B includes a fifteenth corner portion 514 and a sixteenth corner portion 515. The fifteenth corner portion 514 is formed by the fifth lateral surface 240*g* and the wall surface 222*a*. The sixteenth corner portion 515 is formed by the fifth lateral surface 240*g* and the end surface 240*f*. In other words, both the fifteenth corner portion 514 and the sixteenth corner portion 515 are formed to surround the atmosphere opening port 231. When viewed from the second direction Y, the fifteenth corner portion 514 and the sixteenth corner portion 515 have a rectangular shape. In this embodiment, the fifteenth corner portion 514 corresponds to the corner portion disclosed in the claims.

Since the atmosphere opening port 231 is open in the end surface 240*f* of the convex portion 240B, as described above, the periphery of the atmosphere opening port 231 is surrounded by the fifteenth corner portion 514. Thereby, the fifteenth corner portion 514 is formed. Thus, the ink applied to the Z2 side of the wall surface 222*a*, which is the side located further to the upper side in the vertical direction than the atmosphere opening port 231, moves along the fifteenth corner portion 514 on the Z2 side, that is, the upper side in the vertical direction, of the atmosphere opening port 231. Accordingly, since the ink applied to the wall surface 222*a* moves along the fifteenth corner portion 514, the ink can be prevented from entering through the atmosphere opening port 231. Particularly, since the fifteenth corner portion 514 is formed by the convex portion 240B of this embodiment, it is difficult for the ink applied to the wall surface 222*a* to get over the convex portion 240B. As a result, it is difficult for the ink to get over the fifteenth corner portion 514 and thus the ink can be prevented from entering through the atmosphere opening port 231.

Furthermore, in this embodiment, the sixteenth corner portion 515 is provided in a portion between the fifteenth corner portion 514 and the atmosphere opening port 231. Thus, even when the ink gets over the fifteenth corner portion 514, the sixteenth corner portion 515 prevents the ink from moving to the atmosphere opening port 231 side. As a result, the ink can be prevented from entering through the atmosphere opening port 231.

In addition, in this embodiment, the fifteenth corner portion 514 continuously extends along the periphery of the atmosphere opening port 231. Accordingly, not only in a case where the liquid ejection surface 20*a* is disposed to be directed vertically downward, but also in a case where the liquid ejection surface 20*a* is disposed to be directed vertically upward or sideways, perpendicular to the vertical direction, when the ink applied to the wall surface 222*a* moves along the wall surface 222*a*, the fifteenth corner portion 514 can prevent the ink from entering through the atmosphere opening port 231. In other words, since the fifteenth corner portion 514 extends along the periphery of the atmosphere opening port 231, the ink jet type recording head 200 can be used in any angular position.

Embodiment 7

Figure 18A:
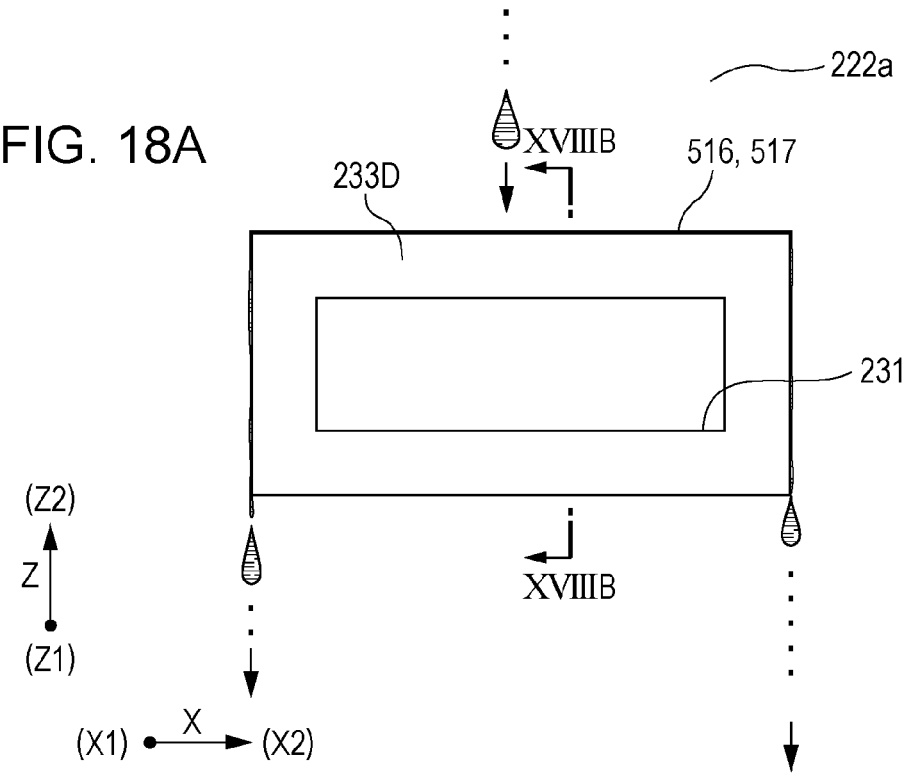
FIG. 18A is an enlarged plan view of a principal portion of a recording head according to Embodiment 7 and FIG. 18B is an enlarged cross-sectional view of the principal portion.
Figure 18B:
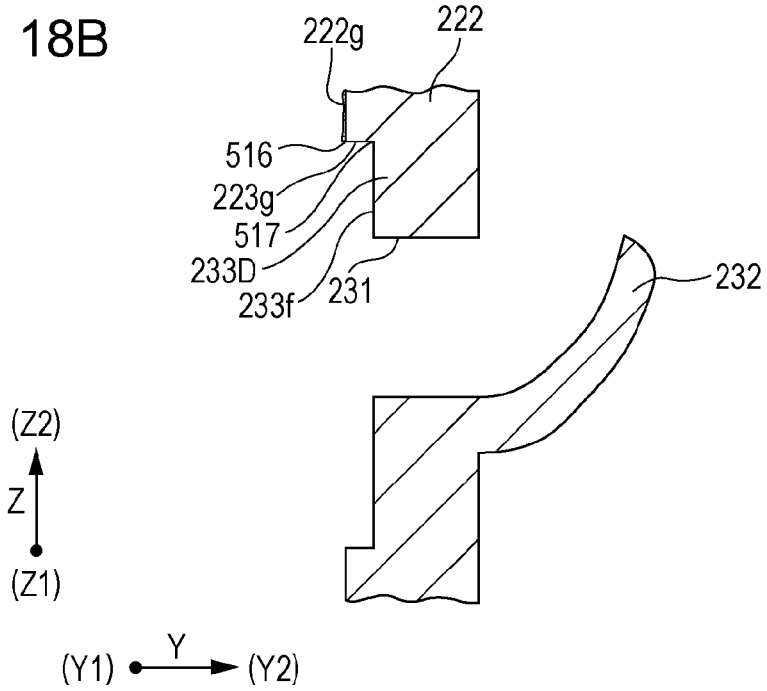

FIG. 18A is an enlarged plan view of a principal portion of a wall surface of an ink jet type recording head as an example of a liquid ejecting head according to Embodiment 7 of the invention and FIG. 18B is a cross-sectional view taken along line XVIIIB-XVIIIB. The same reference numerals are given to members having the same configurations as those in the embodiments described above. The descriptions thereof will not be repeated.

A groove portion 233D is provided on the wall surface 222*a*, as illustrated in FIGS. 18A and 18B. The atmosphere opening port 231 is open in a bottom surface 233*f* of the groove portion 233D. In other words, the groove portion 233D has the bottom surface 233*f* and a fifth lateral surface 233*g*. The fifth lateral surface 233*g* is perpendicular to both the bottom surface 233*f* and the wall surface 222*a*. The groove portion 233D includes a seventeenth corner portion 516 and an eighteenth corner portion 517. The seventeenth corner portion 516 is formed by the fifth lateral surface 233*g* and the wall surface 222*a*. The eighteenth corner portion 517 is formed by the fifth lateral surface 233*g* and the bottom surface 233*f*. In other words, both the seventeenth corner portion 516 and the eighteenth corner portion 517 are formed to surround the atmosphere opening port 231. When viewed from the second direction Y, the seventeenth corner portion 516 and the eighteenth corner portion 517 have a rectangular shape. In this embodiment, the seventeenth corner portion 516 corresponds to the corner portion disclosed in the claims.

Since the atmosphere opening port 231 is open in the bottom surface 233*f* of the groove portion 233D, as described above, the periphery of the atmosphere opening port 231 is surrounded by the seventeenth corner portion 516. Furthermore, the seventeenth corner portion 516 is formed. Thus, the ink applied to the Z2 side of the wall surface 222*a*, which is the side located further to the upper side in the vertical direction than the atmosphere opening port 231, moves along the seventeenth corner portion 516 on the Z2 side, that is, the upper side in the vertical direction, of the atmosphere opening port 231. Accordingly, since the ink applied to the wall surface 222*a* moves along the seventeenth corner portion 516, the ink can be prevented from entering through the atmosphere opening port 231.

In this embodiment, since the seventeenth corner portion 516 can be formed without a convex portion, it is possible to reduce the width of the ink jet type recording head 200 in the second direction Y.

Furthermore, in this embodiment, the eighteenth corner portion 517 is provided in a portion between the seventeenth corner portion 516 and the atmosphere opening port 231. Thus, even when the ink gets over the seventeenth corner portion 516, the eighteenth corner portion 517 prevents the ink from moving to the atmosphere opening port 231 side. As a result, the ink can be prevented from entering through the atmosphere opening port 231.

In addition, in this embodiment, the seventeenth corner portion 516 continuously extends along the periphery of the atmosphere opening port 231. Accordingly, not only in the case where the liquid ejection surface 20*a* is disposed to be directed vertically downward, but also in the case where the liquid ejection surface 20*a* is disposed to be directed vertically upward or sideways, perpendicular to the vertical direction, when the ink applied to the wall surface 222*a* moves along the wall surface 222*a*, the seventeenth corner portion 516 can prevent the ink from entering through the atmosphere opening port 231. In other words, since the seventeenth corner portion 516 extends along the periphery of the atmosphere opening port 231, the ink jet type recording head 200 can be used in any angular position.

Embodiment 8

Figure 19A:
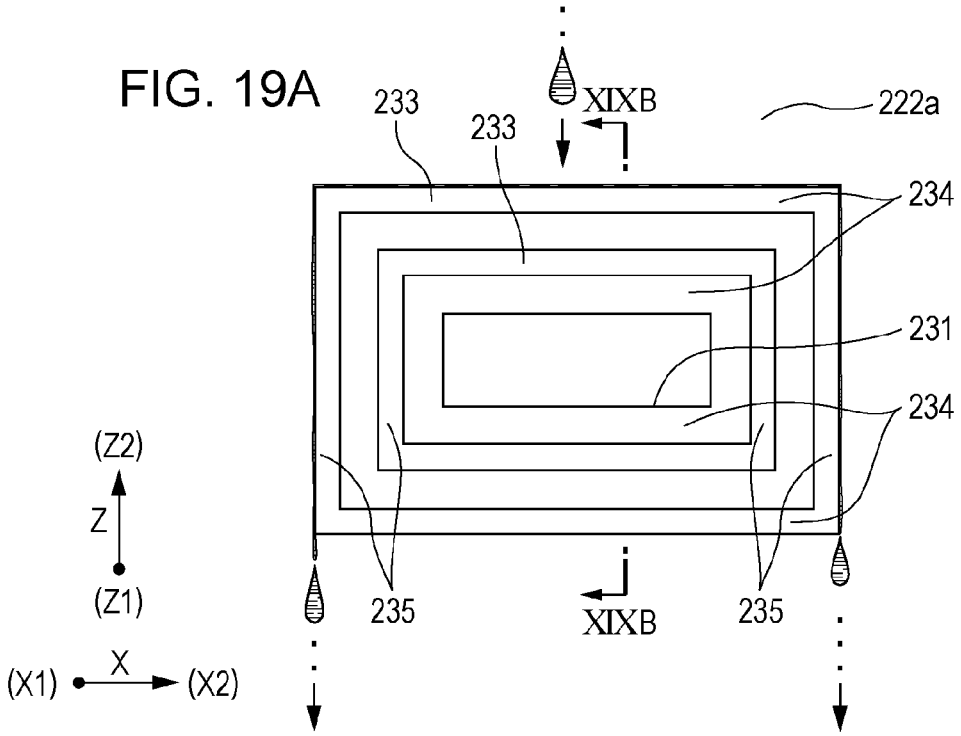
FIG. 19A is an enlarged plan view of a principal portion of a recording head according to Embodiment 8 and FIG. 19B is an enlarged cross-sectional view of the principal portion.
Figure 19B:
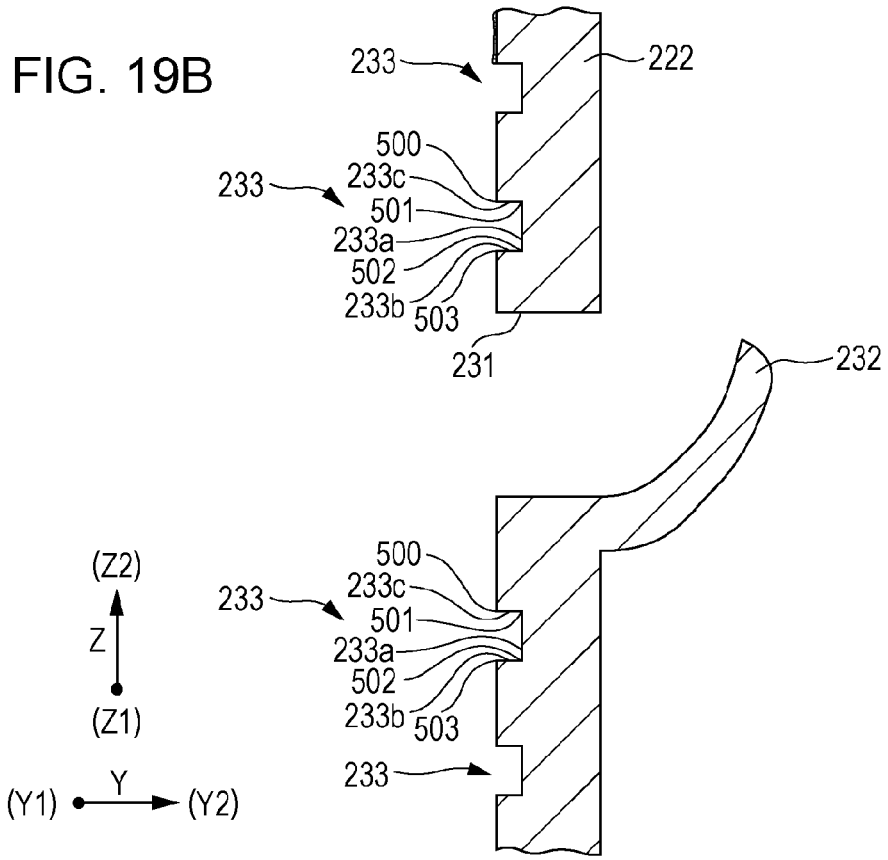

FIG. 19A is an enlarged plan view of a principal portion of a wall surface of an ink jet type recording head as an example of a liquid ejecting head according to Embodiment 8 of the invention and FIG. 19B is a cross-sectional view taken along line XIXB-XIXB. The same reference numerals are given to members having the same configurations as those in the embodiments described above. The descriptions thereof will not be repeated.

Two groove portions 233 are provided in the wall surface 222*a* to continuously extend along the periphery of the atmosphere opening port 231, as illustrated in FIGS. 19A and 19B. The groove portion 233 of this embodiment has the same configuration as that in Embodiment 1 described above.

Four corner portions, in total, which are the first corner portion 500, the second corner portion 501, the third corner portion 502, and the fourth corner portion 503 are formed for each groove portion 233. Thus, eight corner portions are provided in the wall surface 222*a* in total.

Accordingly, even when the ink gets over the corner portion, it is possible to reliably prevent the ink from reaching the atmosphere opening port 231.

Needless to say, such a configuration may be used in combination with Embodiments 2 to 7 described above.

Other Embodiments

Hereinbefore, each embodiment of the invention is described. However, the basic configuration of the invention is not limited to the configurations described above.

In each embodiment described above, the connection path 230 is disposed further to the upper side in the vertical direction than the atmosphere opening port 231. However, without being limited thereto, the connection path 230 may be disposed further to the lower side in the vertical direction than the atmosphere opening port 231. In this case, the first space portion 430 can receive ink up until the liquid level of ink reaches the connection path 230. However, since the wall portion 232 or a corner portion, such as the first corner portion 500, is provided in the atmosphere opening port 231, the ink can be prevented from entering the first space portion 430 through the atmosphere opening port 231. As a result, even when the receivable amount in the first space portion 430, of ink, is small, it is possible to increase the life span until the liquid level of the reserved ink reaches the connection path 230.

In each embodiment described above, the atmosphere opening path 33 of the head main body 210 and the atmosphere opening path (not illustrated) communicating with the space 95 surrounded by the cover head 270, the opening portion 94 and the sealing film 92 are open to atmosphere through the communication hole 228, the second space portion 431, the connection path 230, the first space portion 430, and the atmosphere opening port 231. However, the configuration of the atmosphere opening path of the 210 is not limited thereto. In addition, when the atmosphere opening path is provided in the flow-path member 220, atmospheric opening may be performed in such a manner that the atmosphere opening path of the flow-path member 220 communicates with any one of the communication hole 228, the second space portion 431, the connection path 230, the first space portion 430 or the atmosphere opening port 231. Needless to say, even in a case where the atmosphere opening path does not communicate with the second space portion 431, when, for example, a corner portion is provided, it is possible to prevent damage or short-circuiting of the circuit substrate 250 held in the second space portion 431. In addition, it is possible to prevent damage or short-circuiting of the external wiring substrate 260, the wiring substrate 121, and the like, which are connected to the circuit substrate 250.

In each embodiment described above, the atmosphere opening port 231 is provided in a state where the atmosphere opening port 231 communicates with the first space portion 430. However, without being limited thereto, the atmosphere opening port 231 may communicate with the second space portion 431, that is, the atmosphere opening port 231 is provided in the second covering member 223. Needless to say, the corner portion formed by the groove portion or the convex portion may be provided in the second covering member 223. In other words, the first space portion 430, the connection path 230, or the like may not be provided in the ink jet type recording head 200. Similarly, the corner portion formed by the groove portion or the convex portion may not be provided in the ink jet type recording head 200 and only the first space portion 430, the second space portion 431, and the connection path 230 may be provided. In addition, only the wall portion 232 may be provided in addition to the first space portion 430, the second space portion 431, and the connection path 230. In other words, even when the corner portion is not provided, when the first space portion 430, the second space portion 431, and the connection path 230 are provided, the ink is reserved in the first space portion 430. As a result, the ink can be prevented from entering through the atmosphere opening path of the head main body 210 and it is possible to prevent, for example, damage of the circuit substrate 250 due to ink. Furthermore, when the wall portion 232 is provided, the ink can be prevented from entering the first space portion 430.

In each embodiment described above, the corner portion continuously extends along the periphery of the atmosphere opening port 231. However, without being limited thereto, the corner portion may discontinuously extend along the periphery of the atmosphere opening port 231. In other words, the end portions of both the first groove portions 234 and the second groove portions 235 of Embodiment 1 described above may be disposed to be, for example, separated from each other such that the end portions are not connected to each other. However, the corner portion discontinuously extends, and thus there is a concern that the ink may move to the atmosphere opening port 231 side, from the area in which the corner portion does not continuously extend, that is, the area between the non-connected end portions of both the first groove portion 234 and the second groove portion 235. Accordingly, it is preferable that the corner portion continuously extend along the entirety of the periphery of the atmosphere opening port 231.

In each embodiment described above, a thin-film type piezoelectric actuator 300 is used as a pressure generation unit for generating changes in the pressure of the pressure generation chamber 12. However, the type of the piezoelectric actuator is not limited thereto. For example, a thick-film type piezoelectric actuator formed by, for example, attaching a green sheet or a longitudinal oscillation type piezoelectric actuator in which piezoelectric materials and electrode forming materials are alternately stacked on each other and the stacked materials expand and contract in an axial direction can be used as a pressure generation unit. Furthermore, an actuator in which a heater element is disposed in the pressure generation chamber and liquid droplets are discharged through nozzle openings, using bubbles generated by heating the heater element or a so-called electrostatic actuator in which static electricity is generated between a diaphragm and an electrode and liquid droplets are discharged through nozzle openings, by deforming the diaphragm using an electrostatic force can be used as a pressure generation unit.

Figure 20:
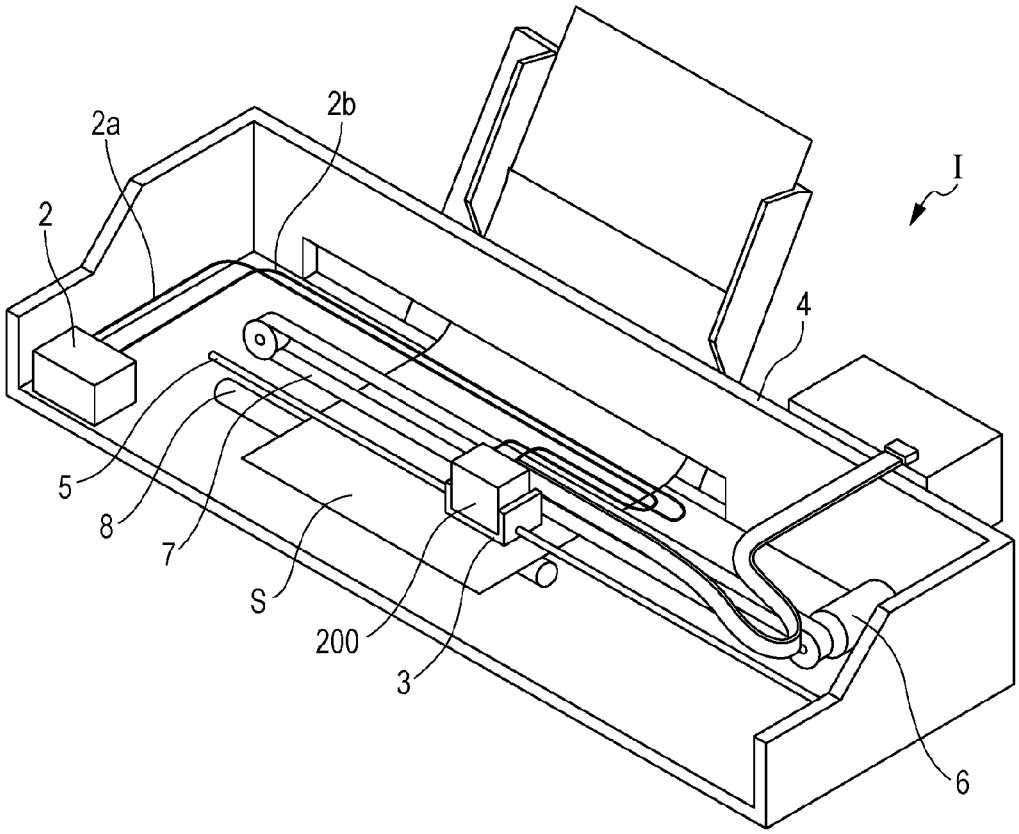
FIG. 20 is a schematic perspective view of a recording apparatus according to an embodiment.

The ink jet type recording head 200 of the embodiments described above is mounted on an ink jet type recording apparatus as an example of a liquid ejecting apparatus. Here, the ink jet type recording apparatus of this embodiment will be described. FIG. 20 is a schematic perspective view illustrating an ink jet type recording apparatus as an example of the liquid ejecting apparatus according to an embodiment of the invention.

An ink jet type recording apparatus I includes a carriage 3 having the ink jet type recording head 200 mounted thereon, as illustrated in FIG. 20. The carriage 3 is axially-movably installed in a carriage shaft 5 provided in an apparatus main body 4.

The carriage 3 having the ink jet type recording head 200 mounted thereon moves along the carriage shaft 5, in such a manner that a driving force of a driving motor 6 is transmitted to the carriage 3 via a plurality of gears (not illustrated) and a timing belt 7. Meanwhile, a transporting roller 8 is provided, as a transporting unit, in the apparatus main body 4. The recording sheet S, such as a paper sheet, as a recording medium is transported by the transporting roller 8. The transporting unit for transporting the recording sheet S is not limited to the transporting roller and may be a belt, a drum, or the like.

A liquid reservoiring unit 2, such as an ink tank, which is fixed the apparatus main body 4 and has ink reserved therein is provided in the ink jet type recording apparatus I. Both a supply pipe 2*a* and a recovery pipe 2*b* are connected to the liquid reservoiring unit 2. The ink is supplied to the ink jet type recording head 200 through the supply pipe 2*a* and the ink is recovered from the ink jet type recording head 200 through the recovery pipe 2*b*.

Both the supply pipe 2*a* and the recovery pipe 2*b* are constituted by pipe-shaped members, such as flexible tubes. A supply path through which the ink is supplied is provided in the supply pipe 2*a* and a recovery path through which the ink is recovered is provided in the recovery pipe 2*b*. One end of the supply pipe 2*a* is connected to the introduction port 411 of the supply flow path 410 of the ink jet type recording head 200. One end of the recovery pipe 2*b* is connected to a discharge port 421 of the recovery flow path 420. As a result, the ink in the liquid reservoiring unit 2 is supplied to the ink jet type recording head 200 and the ink is recovered from the ink jet type recording head 200 to the liquid reservoiring unit 2.

Although not specifically illustrated, a pumping unit, such as a pressure pump and a suction pump, is provided in the middle of the supply pipe 2*a* or the recovery pipe 2*b*. Accordingly, the ink is circulated between the liquid reservoiring unit 2 and the ink jet type recording head 200, by pumping the pumping unit.

A configuration in which the ink jet type recording head 200 moves in a main scanning direction, in a state where the ink jet type recording head 200 is mounted on the carriage 3 is exemplified in the example illustrated in FIG. 20. However, the configuration is not limited thereto. The invention can also be applied to, for example, a so-called line type recording apparatus in which the ink jet type recording head 200 is fixed and printing is performed by moving only the recording sheet S, such as a paper sheet, in a sub-scanning direction.

The ink jet type recording head 200 having a configuration in which the ink is supplied from the liquid reservoiring unit 2 to the ink jet type recording head 200 and the ink is recovered from the ink jet type recording head 200 to the liquid reservoiring unit 2 is exemplified in the example described above. However, the configuration is not particularly limited thereto. The invention can be applied to an ink jet type recording head having a configuration in which only supplying ink from the liquid reservoiring unit 2 to the ink jet type recording head 200 is performed.

In the example described above, the liquid reservoiring unit 2 is fixed to the apparatus main body 4 and the ink is supplied to the ink jet type recording head 200 through the supply pipe 2*a*. However, the configuration is not limited thereto. A liquid reservoiring unit, such as an ink cartridge, is mounted on the carriage 3, and thus a liquid reservoiring unit may move, along with the ink jet type recording head 200, along the carriage shaft 5. A liquid reservoiring unit may not be mounted on the ink jet type recording apparatus I.

In the example described above, the ink jet type recording head 200 is disposed in a state where the liquid ejection surface 20*a* is directed vertically downward. However, the configuration is not limited thereto. A plurality of ink jet type recording heads 200 may be disposed in a state where respective liquid ejection surfaces thereof are directed toward different directions. Such an example is illustrated in FIG. 21.

Figure 21:
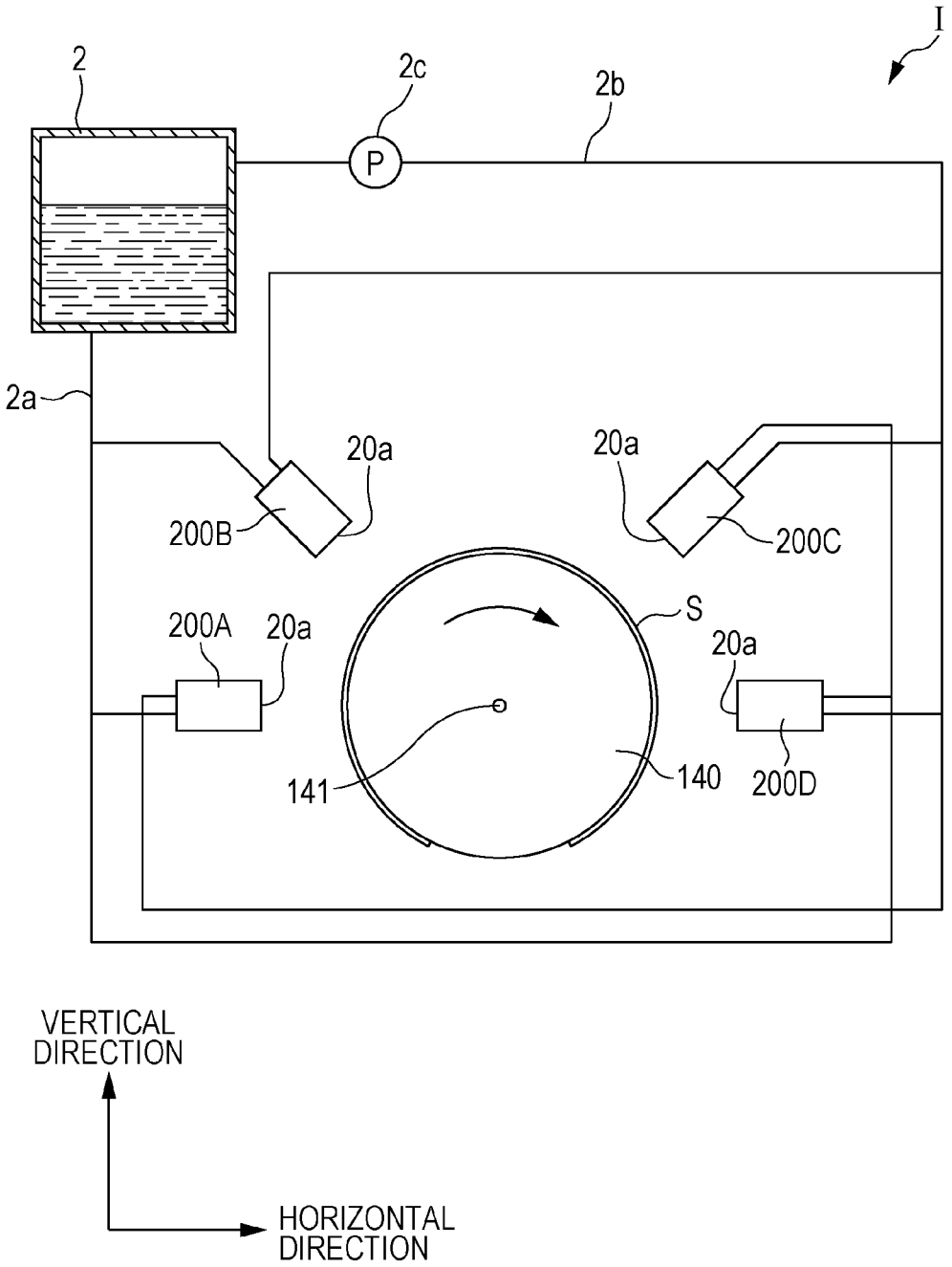
FIG. 21 is a schematic view of a recording apparatus according to an embodiment.

The ink jet type recording apparatus I includes a supporting member 140 having a cylindrical shape, a plurality of ink jet type recording heads 200A to 200D disposed in a state where the liquid ejection surfaces 20*a* for ejecting ink face the supporting member 140, and the liquid reservoiring unit 2 in which ink to be supplied to the ink jet type recording heads 200A to 200D is reserved, as illustrated in FIG. 21.

The supporting member 140 supports a surface of the recording sheet S as an ejection receiving medium, such as a paper sheet, transported by a transporting unit (not illustrated), which is the surface on a side opposite to a surface side on which ink droplets land. The holding method of the supporting member 140, relative to the recording sheet S, is not particularly limited. A method in which the surface of the recording sheet S which is opposite to an ink landing surface is adhered, in a suction manner, to the surface of the supporting member 140 can be exemplified. A method in which the outer circumferential surface of the recording sheet S is subjected to charging and the recording sheet S is adhered to the supporting member 140 by the effect of dielectric polarization can be exemplified as another example of the holding method. A pressing roller may be provided to support the recording sheet S in a portion between the pressing roller and the surface of the supporting member 140.

The axis of the supporting member 140 is supported by a rotation shaft 141, in a state where the supporting member 140 rotates in a circumferential direction. The supporting member 140 is rotationally driven by a driving unit, such as a driving motor (not illustrated).

The plurality of ink jet type recording heads 200A to 200D are arranged in a state where the liquid ejection surfaces 20*a* face, at different installation angles, a surface of the recording sheet S, which is supported by the supporting member 140 and on which ink droplets land. In other words, the ink jet type recording heads 200A to 200D are arranged in a state where the plane directions of the liquid ejection surfaces 20*a* intersect with each other.

Specifically, four recording heads which are the first ink jet type recording head 200A, the second ink jet type recording head 200B, the third ink jet type recording head 200C, and the fourth ink jet type recording head 200D are provided in the periphery of the supporting member 140 of this embodiment. Positions of the four ink jet type recording heads 200A to 200D in the third direction Z are not matched to each other. In other words, the first ink jet type recording head 200A is disposed in a state where the liquid ejection surface 20*a* is directed toward the horizontal direction perpendicular to the vertical direction. That is, the plane direction of the liquid ejection surface 20*a* of the first ink jet type recording head 200A is parallel to the vertical direction. In contrast, the second ink jet type recording head 200B is disposed in a state where the liquid ejection surface 20*a* faces the supporting member 140 at the angle, for example, 45 degrees, inclined with respect to the vertical direction. The third ink jet type recording head 200C is disposed in a state where the liquid ejection surface 20*a* faces the supporting member 140 at an angle, for example, of 45 degrees, inclined with respect to the vertical direction. Furthermore, the liquid ejection surface 20*a* of the second ink jet type recording head 200B and the liquid ejection surface 20*a* of the third ink jet type recording head 200C are disposed at different angles, for example, 90 degrees, in this embodiment. The fourth ink jet type recording head 200D is disposed in a state where the liquid ejection surface 20*a* is directed toward the horizontal direction perpendicular to the vertical direction. The first ink jet type recording head 200A and the fourth ink jet type recording head 200D face each other in a state where the respective recording heads are disposed at 90 degrees, with respect to the supporting member 140. As described above, the plane directions of the liquid ejection surfaces 20*a* of the first ink jet type recording head 200A and the fourth ink jet type recording head 200D are the same, that is, the plane directions are parallel to the vertical direction and do not intersect with each other. However, the plane directions of the first ink jet type recording head 200A and the fourth ink jet type recording head 200D intersect with the plane directions of the liquid ejection surfaces 20*a* of the other ink jet type recording heads 200B and 200C. In other words, it is possible to say that the liquid ejection surface 20*a* of the first ink jet type recording head 200A as a first liquid ejecting head is disposed in a different direction, with respect to the liquid ejection surface 20*a* of the second ink jet type recording head 200B as a second liquid ejecting head, the third ink jet type recording head 200C, or the fourth ink jet type recording head 200D.

The liquid reservoiring unit 2 is connected to the respective ink jet type recording heads 200A to 200D through both the supply pipe 2*a* and the recovery pipe 2*b*, such as flexible tubes. The ink from the liquid reservoiring unit 2 is supplied, through the supply pipe 2*a*, to the respective ink jet type recording heads 200A to 200D. Furthermore, the ink not ejected from the ink jet type recording heads 200A to 200D is recovered to the liquid reservoiring unit 2 through the recovery pipe 2*b*. A pump 2*c* is provided in the middle of the recovery pipe 2*b*. Accordingly, the ink from the liquid reservoiring unit 2 passes through and is circulated in the flow paths in the ink jet type recording heads 200A to 200D, by pressure from the pump 2*c*.

In the description of the embodiments described above, an ink jet type recording head is exemplified as an example of a liquid ejection head. However, the invention is intended to be applied to general liquid ejecting heads and can also be applied to a liquid ejecting head which ejects liquid other than ink. Other examples of a liquid ejecting head include various types of recording heads used for an image recording apparatus, such as a printer, a coloring material ejecting head used to manufacture a color filter for a liquid crystal display or the like, an electrode material ejecting head used to form an electrode for an organic EL display, a field emission display (FED) or the like, and a bio-organic material ejecting head used to manufacture a biochip.

What is claimed is:

1. A liquid ejecting head comprising:

a liquid ejection surface through which liquid is ejected;

a head casing body in which the liquid ejection surface is provided on one surface;

an atmosphere opening port which is open in an outer-side wall surface of the head casing body;

a first space portion which communicates with the atmosphere opening port in the head casing body; and a second space portion which communicates with the first space portion through a connection path, wherein the first space portion reserves liquid entering through the atmosphere opening port.

2. The liquid ejecting head according to claim 1, wherein the connection path is disposed further to an upper side in a vertical direction than the atmosphere opening port.

3. A liquid ejecting apparatus comprising:

the liquid ejecting head according to claim 2.

4. The liquid ejecting head according to claim 1, further comprising:

a circuit substrate which is held in the second space portion.

5. The liquid ejecting head according to claim 4, wherein the circuit substrate is connected to an external wiring substrate inserted through a connection hole which is provided in the head casing body and communicates with the second space portion, and wherein the connection hole is sealed by a sealing member.

6. A liquid ejecting apparatus comprising:

the liquid ejecting head according to claim 5.

7. A liquid ejecting apparatus comprising:

the liquid ejecting head according to claim 4.

8. The liquid ejecting head according to claim 1, wherein a wall portion extending from a vertically lower side than the atmosphere opening port to a vertically upper side is provided in an inner-side surface of the first space portion, in which the atmosphere opening port is provided.

9. A liquid ejecting apparatus comprising:

the liquid ejecting head according to claim 1.

10. The liquid ejecting apparatus according to claim 9, further comprising:

a plurality of the liquid ejecting heads, wherein a liquid ejection surface of a first liquid ejecting head and a liquid ejection surface of a second liquid ejecting head are disposed in different directions.

11. A liquid ejecting head comprising:

a liquid ejection surface through which liquid is ejected;

a head casing body in which the liquid ejection surface is provided on one surface;

an atmosphere opening port which is open in an outer-side wall surface of the head casing body; and a corner portion which is provided in the wall surface having an atmosphere opening port formed therein and is formed by the wall surface and a surface intersecting with the wall surface, wherein the corner portion is provided on at least an upper side of the atmosphere opening port in the vertical direction, and wherein, in a direction perpendicular to the vertical direction in the wall surface, the width of the corner portion is greater than that of the atmosphere opening path.

12. The liquid ejecting head according to claim 11, wherein the head casing body includes a first space portion communicating with the atmosphere opening port, and a second space portion connected to the first space portion through a connection path, and wherein the first space portion can receive liquid entering through the atmosphere opening port.

13. The liquid ejecting head according to claim 12, wherein the connection path is disposed further to an upper side in the vertical direction than the atmosphere opening port.

14. A liquid ejecting apparatus comprising:

the liquid ejecting head according to claim 13.

15. A liquid ejecting apparatus comprising:

the liquid ejecting head according to claim 12.

16. The liquid ejecting head according to claim 11, wherein the corner portion is formed to surround the atmosphere opening port.

17. A liquid ejecting apparatus comprising:

the liquid ejecting head according to claim 16.

18. The liquid ejecting head according to claim 11, wherein the corner portion is formed by a concave-shaped groove portion in the wall surface.

19. A liquid ejecting apparatus comprising:

the liquid ejecting head according to claim 9.

20. A liquid ejecting apparatus comprising:

the liquid ejecting head according to claim 11.

* * * * *